US006369501B1

(12) United States Patent
Aoki et al.

(10) Patent No.: US 6,369,501 B1
(45) Date of Patent: Apr. 9, 2002

(54) PLASMA DISPLAY PANEL OF MINUTE CELL STRUCTURE WITH IMPROVED APPLICATION OF FLUORESCENT MATERIAL

(75) Inventors: Masaki Aoki, Mino; Shigeo Suzuki, Hirakata; Mitsuhiro Ohtani, Sakai; Hiroyuki Kawamura, Katano; Hiroyuki Kado, Osaka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/178,365

(22) Filed: Oct. 23, 1998

Related U.S. Application Data

(62) Division of application No. 08/932,508, filed on Sep. 18, 1997, now Pat. No. 5,951,350.

(30) Foreign Application Priority Data

| | | |
|---|---|---|
| Sep. 18, 1996 | (JP) | 8-245853 |
| Jun. 5, 1997 | (JP) | 9-147526 |
| Jun. 6, 1997 | (JP) | 9-149572 |
| Jun. 10, 1997 | (JP) | 9-151789 |
| Jun. 19, 1997 | (JP) | 9-162254 |
| Jul. 24, 1997 | (JP) | 9-198347 |

(51) Int. Cl.[7] ..... H01J 1/62; H01J 63/04; H01J 9/00; H01J 9/24

(52) U.S. Cl. ..... 313/486; 313/582; 313/587; 313/495; 445/24; 445/25

(58) Field of Search ..... 313/495, 496, 313/497, 582, 583, 584, 585, 586, 587, 479, 485, 486, 487; 445/24, 25

(56) References Cited

U.S. PATENT DOCUMENTS

| | | | | | |
|---|---|---|---|---|---|
| 4,325,002 A | * | 4/1982 | Kobale et al. | ..... | 313/485 |
| 4,352,042 A | * | 9/1982 | Lorenz et al. | ..... | 313/485 |
| 4,827,186 A | * | 5/1989 | Knauer et al. | ..... | 313/485 |
| 5,541,479 A | * | 7/1996 | Nagakubo | ..... | 313/586 |
| 5,757,131 A | * | 5/1998 | Tsuchiya | ..... | 313/584 |
| 5,957,743 A | * | 9/1999 | Konishi et al. | ..... | 313/587 |

FOREIGN PATENT DOCUMENTS

| | | | | | |
|---|---|---|---|---|---|
| EP | 0712148 | * | 5/1996 | ..... | 313/582 |
| EP | 806786 | | 11/1997 | | |
| JP | 5379371 | | 7/1978 | | |
| JP | 63155527 | | 6/1988 | | |
| JP | 04047639 A | * | 2/1992 | ..... | 313/234 |
| JP | 04332430 | * | 11/1992 | ..... | 313/582 |
| JP | 8162019 | | 6/1996 | | |

* cited by examiner

*Primary Examiner*—Nimeshkumar D. Patel
*Assistant Examiner*—Mariceli Santiago
(74) *Attorney, Agent, or Firm*—Price and Gess

(57) ABSTRACT

The present invention provides a plasma display panel in which the fluorescent substance layer or the reflection layer is formed easily and accurately even for a minute cell structure, and in which the fluorescent substance layer or the reflection layer is formed evenly in the channels between the partition walls formed in stripes, or such a layer is formed also on the sides of the partition walls. To achieve this purpose, a fluorescent substance layer or a reflection layer is formed by applying a fluorescent substance ink or a reflection material ink continuously onto the channels, the ink being spouted out from a nozzle which runs along the partition walls. The nozzle may be directed to one side of the plurality of partition walls while running. Pressure may be put upon the ink having been applied onto the channels so that the ink sticks to both sides of the partition walls. The ink may be continuously spouted out from a nozzle while a bridge is formed between the nozzle and both sides of the partition walls by surface tension of the ink. A plate with a plurality of partition walls and channels in between may be formed so that adsorption of the sides of the channels against the ink is higher than that of the bottom of the channels.

33 Claims, 16 Drawing Sheets

PLASMA DISPLAY PANEL OF MINUTE CELL STRUCTURE WITH IMPROVED APPLICATION OF FLUORESCENT MATERIAL

RELATED APPLICATIONS

This application is a divisional application of application Ser. No. 08/932,508 filed on Sep. 18, 1997, now U.S. Pat. No. 5,951,350.

BACKGROUND OF THE INVENTION (1) Field of the Invention

This invention relates to a plasma display panel used in a display apparatus, and specifically to a method of producing a plasma display panel suitable for minute cell structure.

(2) Description of the Prior Art

Recently, as the demand for high-quality large-screen TVs such as high-vision TVs has increased, displays suitable for such TVs, such as Cathode Ray Tube (CRT), Liquid Crystal Display (LCD), and Plasma Display Panel (PDP), have been developed.

CRTs have been widely used as TV displays and excel in resolution and picture quality. However, the depth and weight increase as the screen size increases. Therefore, CRTs are not suitable for large screen sizes exceeding 40 inch. LCDs consume a small amount of electricity and operate on a low voltage. However, producing a large LCD screen is technically difficult, and the viewing angles of LCDs are limited.

On the other hand, it is possible to make a PDP with a large screen with a short depth, and 40-inch PDP products have already been developed.

A general PDP is composed of a front cover plate and a back cover plate to each of which electrodes are attached so that the electrodes of both cover plates face each other. A space between the front cover plate and the back cover plate is divided into a plurality of spaces by partition walls. The plurality of spaces between these partition walls are each filled with discharge gas and any of red, green, and blue fluorescent substances. The PDP with the above construction is produced first by forming the fluorescent substances in the channels between the partition walls on the back cover plate, placing the front cover plate onto the back cover plate, then charging the discharge gas. A driving circuit is used to fire the electrodes for driving.

The light-emission principle in PDP is basically the same as that in fluorescent light: a discharge lets the discharge gas emit ultraviolet light; the ultraviolet light excites fluorescent substances; and the excited fluorescent substances emit red, green, and blue lights. However, since discharge energy is not effectively converted to ultraviolet light and conversion ratio in fluorescent substance is low, it is difficult for PDPs to provide brightness as high as that of fluorescent lights.

PDPs are divided into two types: Direct Current (DC) type and Alternating Current (AC) type. The electrodes of the DC type are exposed in the discharge space, while the electrodes of the AC type are covered by a dielectric glass layer.

The shapes of the partition walls are also different: the partition walls of the AC type are formed in stripes; the partition walls of the DC type are formed in a lattice shape. Of these, the AC type is suitable for forming a panel with a minute cell structure.

Meanwhile, as the demand for high-quality displays has increased, minute cell structures have been desired also in PDPs.

For example, in 40-inch screens conforming to the National Television System Committee (NTSC) standard, the number of pixels is 640×480, the cell pitch 0.43 mm×1.29 mm, and the square of one cell about 0.55 $mm^2$. While in 42-inch high-vision TVs, the number of pixels is 1,920×1,125, cell pitch 0.15 mm×0.48 mm, and square of one cell 0.072 $mm^2$.

To bring such PDPs with minute cell structures into practical use, the light emission efficiency should be increased. As a result, studies for improving fluorescent substances, for example, are under way for this purpose.

However, the problems shown below are seen in forming fluorescent substance layers.

As shown in FIG.1, a popular conventional method of forming a fluorescent substance layer uses the screen printing method in which fluorescent substance pastes are supplied to depression parts between the partition walls and they are baked. However, it is difficult to apply the screen printing method to PDPs with minute cell structures.

When the cell pitch is in a range of 0.1–0.15 mm, the width of each space between the partition walls becomes very narrow, namely, in the range of 0.08–0.1 mm. Fluorescent substance inks used in the screen printing have high viscosity (generally, several hundreds of thousands centipoise (cP)). It is difficult to pour such a high-viscosity fluorescent substance ink into a narrow channel between the partition walls accurately and at high speed.

To acquire high-light-emission PDPs, it is desirable to construct the PDPs so that the fluorescent substance layer is formed not only on the surface of the back plate but on the sides of the partition walls and that discharge spaces are secured between the partition walls. To fulfill the above construction in the screen printing method, for example, an appropriate amount of fluorescent substance paste should be applied onto the surface of the back plate and onto the sides of the partition walls by controlling the viscosity of the fluorescent substance paste. However, it is difficult to set the viscosity of the fluorescent substance paste to an appropriate level. It is also difficult to apply the fluorescent substance paste onto the sides of the partition walls.

There are other methods of forming the fluorescent substance layer than the screen printing method, such as the photoresist film method and the ink jet method.

Japanese Laid-Open Patent No.6-273925 describes the photoresist film method. According to the description, a ultraviolet ray photosensitive resin film containing fluorescent substances with various colors are embedded in the channels between the partition walls, only the film parts which are to be the fluorescent substance layers of desired colors are exposed, and the rest of the film is swept away by a liquid. It is possible with this method to embed the film into channels between the partition walls accurately even if the cell pitch is narrow. However, the production procedure of this method is complex since the film embedding and sweeping should be repeated for each of the three colors. Moreover, the method often allows the colors to mix with each other. The method also has a problem of cost since it is difficult to collect the swept fluorescent substances though the fluorescent substances are relatively expensive.

Japanese Laid-Open Patents No.53-79371 and No.8-162019 disclose the ink jet method. According to the disclosure, an ink, containing fluorescent substances and organic binders, is spouted out of running nozzles onto the surface of an insulating substrate when put under pressure so that a desired pattern is drawn on the surface. This method also enables an application of the ink onto surfaces of the narrow channels between the partition walls.

However, when the partition walls are formed in stripes, it is difficult for the method to form a layer of the applied ink with a constant layer thickness since the ink is applied intermittently in the form of liquid drops. The method also has the same problem as the photoresist film method, that is, it is difficult to apply the fluorescent substance paste onto the sides of the partition walls.

Meanwhile, there is another known method for PDPs in which reflection layers are first formed inside the depression parts between the partition walls, then fluorescent substance layers are formed on the reflection layers (e.g. Japanese Laid-Open Patent No.4-332430).

The screen printing method may also be used to apply a paste containing a reflection material to the parts between the partition walls to generate the reflection layers. However, forming of the reflection layers with the screen printing method has the same problems as that of the fluorescent substance layers, that is, it is difficult to apply the reflection material paste to minute cell structures and difficult to apply the reflection material paste onto the sides of the partition walls.

Another problem in forming the fluorescent substance layers or the reflection layers is that the fluorescent substances or the reflection materials often stick to the top of the partition walls. When this happens, the adhesion between the top of the partition walls and the front cover plate may be weakened when they are bonded with each other.

There is another problem concerning forming of electrodes. In conventional PDPs, the width of display electrodes or address electrodes is 130–150 $\mu$m. These electrodes are generally formed with the screen printing method. However, in case of the high-vision TVs, the width should be around 70 $\mu$m considering the number of pixels. In case of a higher-vision 20-inch SXGA (Super extended Graphics Array) (the number of pixels is 1,280×1,024), the width should be around 50 $\mu$m. It is difficult to form electrodes with such widths with the screen printing method.

SUMMARY OF THE INVENTION

It is therefore the first object of the present invention to provide a method of producing a plasma display panel in which the fluorescent substance layer or the reflection layer is formed easily and accurately even for a minute cell structure, and in which the fluorescent substance layer or the reflection layer is formed evenly in the channels between the partition walls formed in stripes.

It is the second object of the present invention to provide a method of producing a plasma display panel in which the fluorescent substance layer or the reflection layer is easily formed on the sides of the partition walls.

It is the third object of the present invention to prevent the fluorescent substance or the reflection material from sticking to the top of the partition walls when the fluorescent substance layer or the reflection layer is formed.

It is the fourth object of the present invention to provide a method of producing a plasma display panel in which the display electrode or the address electrode is easily formed even for a minute cell structure.

The first object of the present invention is achieved by a method of producing a plasma display panel which includes a process of forming a fluorescent substance layer or a reflection layer. In this process, a fluorescent substance layer or a reflection layer is formed by applying a fluorescent substance ink or a reflection material ink continuously onto a plurality of channels between a plurality of partition walls formed in stripes on a plate, where the fluorescent substance ink or the reflection material ink is continuously spouted out from a nozzle which runs along the plurality of partition walls.

The first and second objects are achieved by the above method by directing the nozzle to one side of the plurality of partition walls when it runs along the plurality of partition walls spouting out the fluorescent substance ink or the reflection material ink.

The first and second objects are also achieved by the above method by putting an external force upon the fluorescent substance ink or the reflection material ink having been applied onto the plurality of channels so that the fluorescent substance ink or the reflection material ink sticks to both sides of each pair of partition walls.

The first and second objects are also achieved by the above method by applying the fluorescent substance ink or the reflection material ink continuously onto the plurality of channels, in which the fluorescent substance ink or the reflection material ink is continuously spouted out from the nozzle running while a bridge is formed between the nozzle and inside of a channel by surface tension of the fluorescent substance ink or the reflection material ink.

The second object is achieved by a process of forming a plate with a plurality of partition walls on it generating a plurality of channels between the plurality of partition walls. The plate is formed with the process so that adsorption of the sides of the channels against the fluorescent substance ink or the reflection material ink is higher than adsorption of the bottom of the channels against the same.

The third object is achieved by a process of forming a plate with a plurality of partition walls on it for generating a plurality of channels between the plurality of partition walls. The plate is formed in the process so that adsorption of the sides of the partition walls against the fluorescent substance ink or the reflection material ink is higher than adsorption of the top of the partition. walls against the same.

The fourth object is achieved by forming a plurality of electrodes on a plate in stripes by continuously applying an electrode material ink containing an electrode material, where the electrode material ink is continuously spouted out from a running nozzle.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENTS

Embodiment 1

<Structure and Production Method of PDP>

Figure 1A:
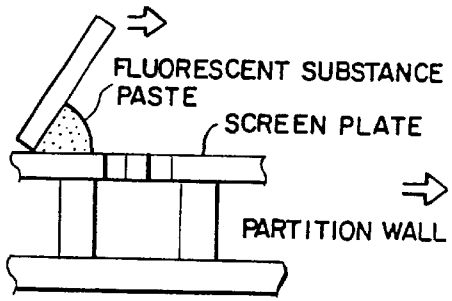
PRIOR ART FIG. 1A
FIG. 1 shows a conventional application of a fluorescent substance paste onto the channels between the partition walls with the screen printing method.
Figure 1B:
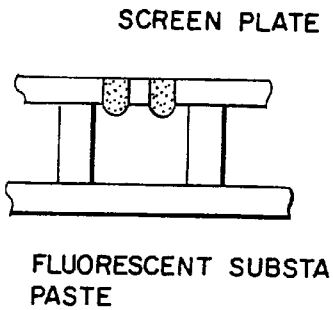
PRIOR ART FIG. 1B
Figure 1C:
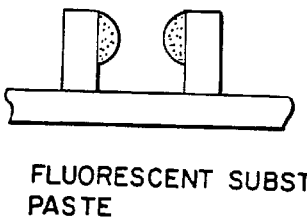
PRIOR ART FIG. 1C
Figure 1D:
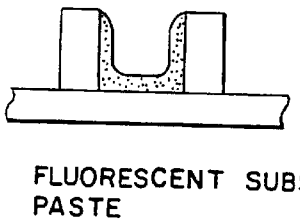
PRIOR ART FIG. 1D
Figure 2:
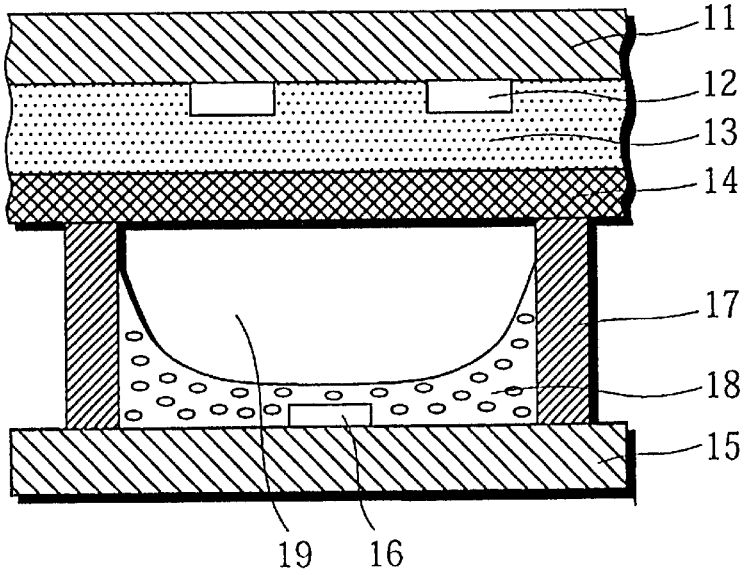
FIG. 2 is a sectional view of the AC-type discharge PDP of an Embodiment of the present invention.

FIG. 2 is a sectional view of an AC-type discharge PDP of the present embodiment. Though FIG. 2 shows only one cell, a PDP includes a number of cells each of which emits red, green, or blue light.

Figure 3:
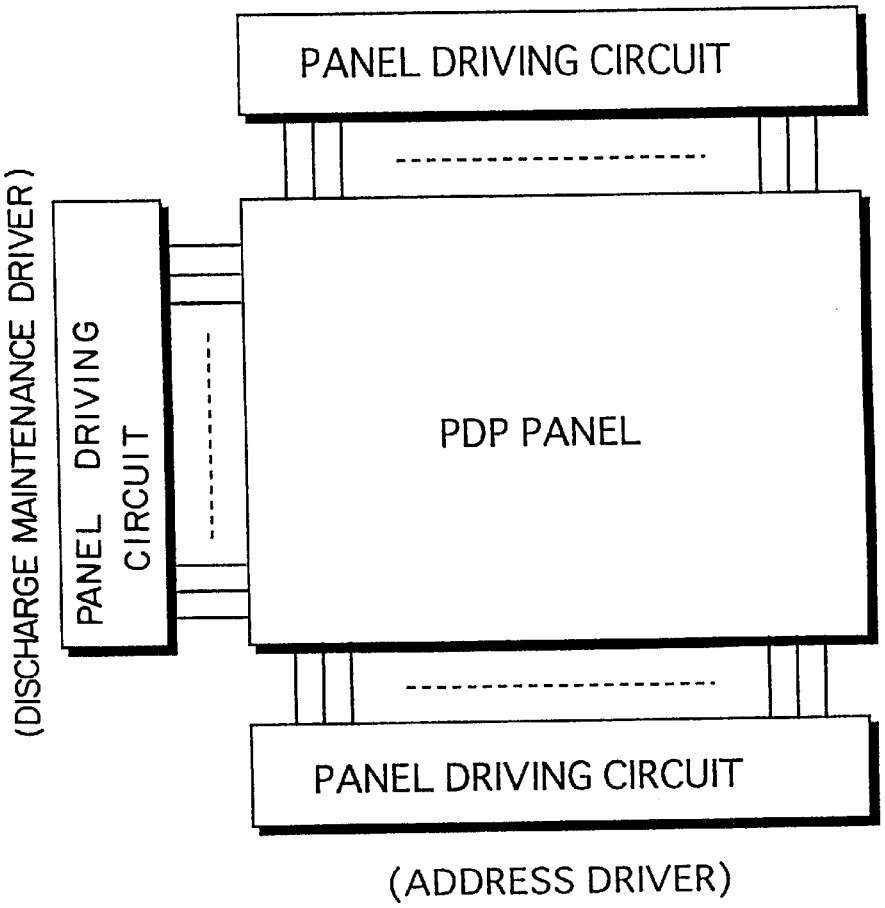
FIG. 3 is a schematic illustration of PDP driving circuits of an Embodiment of the present invention.

The PDP includes: a front panel which is made up of front glass substrate 11 with discharge electrodes 12, dielectrics glass layer 13, and protecting layer 14 thereon; and a back panel which is made up of back glass substrate 15 with address electrode 16, partition walls 17, and fluorescent substance layer 18, the front panel and back panel being bonded together. Discharge space 19, which is sealed with the front panel and back panel, is charged with a discharge gas. Driving circuits shown in FIG. 3 are used to fire discharge electrodes 12 and address electrode 16 to drive them.

Note that FIG. 2 shows a sectional view which is drawn to show all the components and it looks as though discharge electrodes 12 and address electrode 16 run parallel to each other. However, in reality, discharge electrodes 12 is formed to intersect address electrode 16 at right angles.

Producing the Front Panel

The front panel is made by forming discharge electrodes 12 on front glass substrate 11, covering it with dielectrics glass layer 13, then forming protecting layer 14 on the surface of dielectrics glass layer 13.

Discharge electrodes 12 are made of silver. Discharge electrodes 12 may be produced with a conventional screen printing method in which a silver paste for electrodes is baked with the screen printing method. In this embodiment, however, discharge electrodes 12 are formed with the ink jet method, as will be described later.

Dielectrics glass layer 13 is formed, for example, with the following procedure: a mixed material of 70% by weight of lead oxide (PbO), 15% by weight of boron oxide ($B_2O_3$), 10% by weight of silicon oxide ($SiO_2$), 5% by weight of aluminum oxide ($Al_2O_3$), and an organic binder (made by dissolving 10% ethyl cellulose in α-terpineol) is applied by the screen printing method and they are baked for 20 minutes at 520° C. The above process generates dielectrics glass layer 13 with layer thickness of 30 μm.

Protecting layer 14 consists of magnesium oxide (MgO) and is formed, for example, with the sputtering method and its layer thickness 0.5 μm.

Producing the Back Panel

First, address electrode 16 is formed on back glass substrate 15 with the ink jet method.

Secondly, a glass material is repeatedly printed with screen printing method and is baked, resulting in partition walls 17.

Thirdly, fluorescent substance layer 18 is formed between partition walls 17. The fluorescent substance ink is put under pressure so that it is continuously spouted out of running nozzles. The surface on which the fluorescent substance ink is applied is then baked. The method of forming fluorescent substance layer 18 is described later in detail.

Note that in the present embodiment, the height of the partition walls is 0.1–0.15 mm and the pitch of the partition walls is 0.15–0.3 mm, being suitable for 40-inch, high-vision TVs.

Producing a PDP by Bonding Panels

A PDP is made by bonding the above front panel and back panel with sealing glass, at the same time excluding the air from discharge space 19 partitioned by partition walls 17 to a high vacuum ($8\times10^{-7}$Torr), then charging a discharge gas with a certain composition (e.g., He—Xe or Ne—Xe inert gas) into discharge space 19 at a certain charging pressure.

Then, a PDP display apparatus is made after a PDP driving circuit block for driving the PDP is attached to the PDP, as shown in FIG. 3.

Note that in the present embodiment, the discharge gas contains 5% by volume or more of Xe, and the charging pressure is set to the range of 500 to 800 Torr.

Forming the Electrodes and Fluorescent Substance Layer

Figure 4:
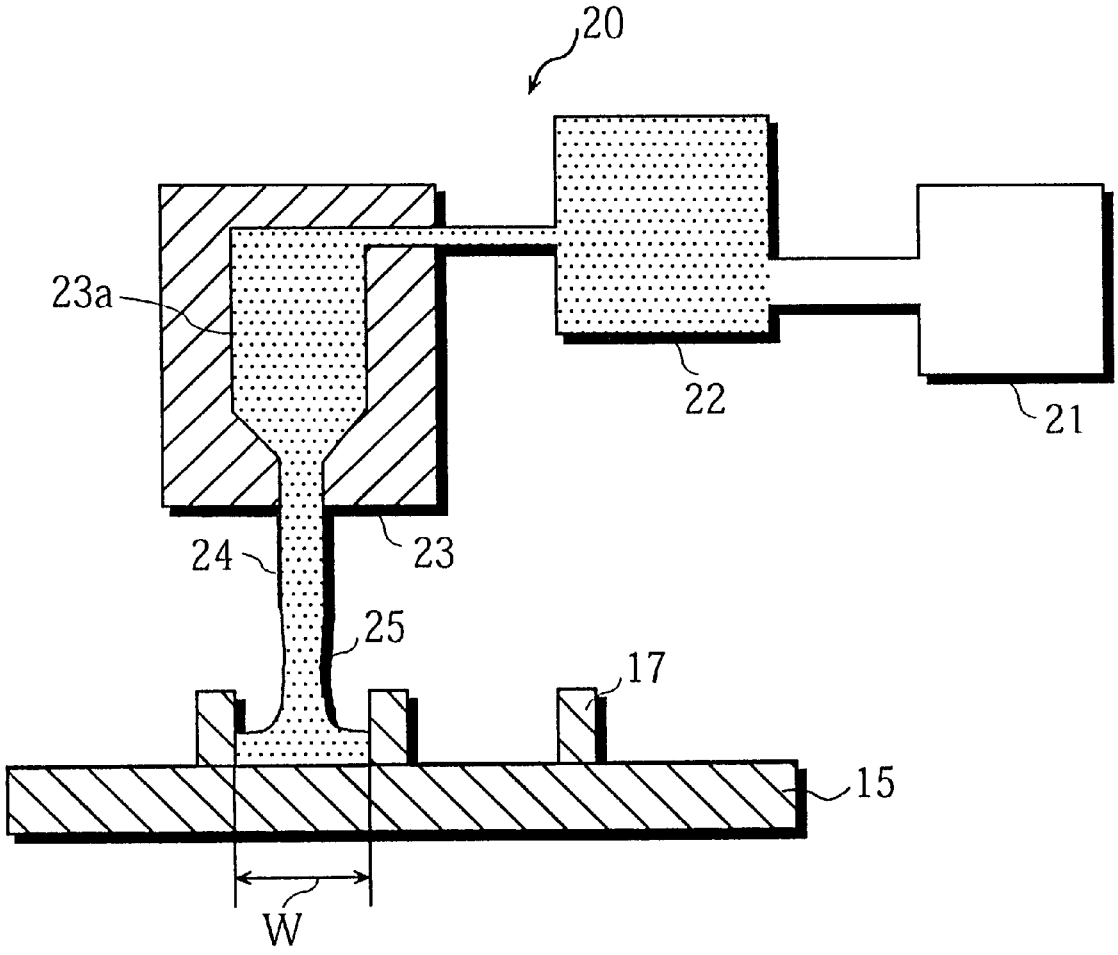
FIG. 4 is a schematic illustration of the ink applying apparatus of Embodiment 1 used for forming the discharge electrodes, address electrode, and fluorescent substance layer.

FIG. 4 is a schematic illustration of ink applying apparatus 20 of Embodiment 1 used for forming discharge electrodes 12, address electrode 16, and fluorescent substance layer 18.

In ink applying apparatus 20 shown in the drawing, server 21 stores electrode material ink or fluorescent substance ink. Pressure pump 22 puts pressure upon either of the above types of ink and supplies the ink to header 23. Header 23 includes ink chamber 23*a* and nozzle 24. With this construction, the ink is continuously spouted out from nozzle 24.

Header 23 is formed as one solid block by processing a metal material by machining and electric discharge machining.

The electrode material ink is made by blending silver grains as an electrode material, glass grains, a binder, a solvent, etc. so that an appropriate viscosity is generated.

The fluorescent substance ink is made by blending fluorescent substance grains of each color, silica, a binder, a solvent, etc. so that an appropriate viscosity is generated.

Fluorescent substances generally used in PDPs can be used as the fluorescent substance grains contained in the fluorescent substance ink. The following are examples of such fluorescent substances:

| | |
|---|---|
| blue fluorescent substance | $BaMgAl_{10}O_{17}:Eu^{2+}$ |
| green fluorescent substance | $BaAl_{12}O_{19}:Mn$ or $Zn_2SiO_4:Mn$ |
| red fluorescent substance | $(Y_xGd_{1-x})BO_3:Eu^{3+}$ or $YBO_3:Eu^{3+}$. |

A desirable mean size of the silver grains and glass material grains used in the electrode material ink and that of the fluorescent substance grains used in the fluorescent substance ink is 5 $\mu$m or less, which is determined to prevent the nozzles from clogging up and to prevent the grains from precipitating. At the same time, it is desirable that the mean size of the fluorescent substance grains is 0.5 $\mu$m or more. Accordingly, in the present embodiment, the size of the silver grains, glass material grains, and fluorescent substance grains is in the range of 0.5–5 $\mu$m (more desirably, in the range of 2–3 $\mu$m).

The desirable range of the viscosity of the fluorescent substance ink is 1000 cP or less at 25° C. The desirable range of the viscosity of the electrode material ink is 100–1000 cP.

The desirable range of the viscosity of the fluorescent substance ink is 1000 cP or less at 25° C. The desirable grain size of silica as an additive is 0.01–0.02 $\mu$m. The desirable amount of silica as an additive is 1–10% by weight. It is also desirable to add 0.1–5% by weight of dispersant and 0.1–1% by weight of plasticizer.

The aperture of nozzle 24 is generally set to the range of 45–150 $\mu$m, the minimum value being determined to prevent the nozzles from clogging up, and the maximum value being determined not to exceed the width W of the space between partition walls 17.

Note that in server 21, a stirrer (not shown in the drawings) stirs the ink stored in server 21 so that the grains, namely, electrode material grains or fluorescent substance grains, in the ink do not precipitate.

The pressure put to the ink by pressure pump 22 is adjusted so that the ink is continuously spouted out from nozzle 24.

Header 23 runs over front glass substrate 11 or back glass substrate 15 linearly. Header 23 is driven by a header driving mechanism (not shown in the drawings). However, header 23 may be fixed at a certain position and the glass substrate may be moved instead.

The ink is applied onto the glass substrate evenly in lines when the ink is spouted out from nozzle 24 by running header 23 to form ink flow 25 (jet line).

Figure 5:
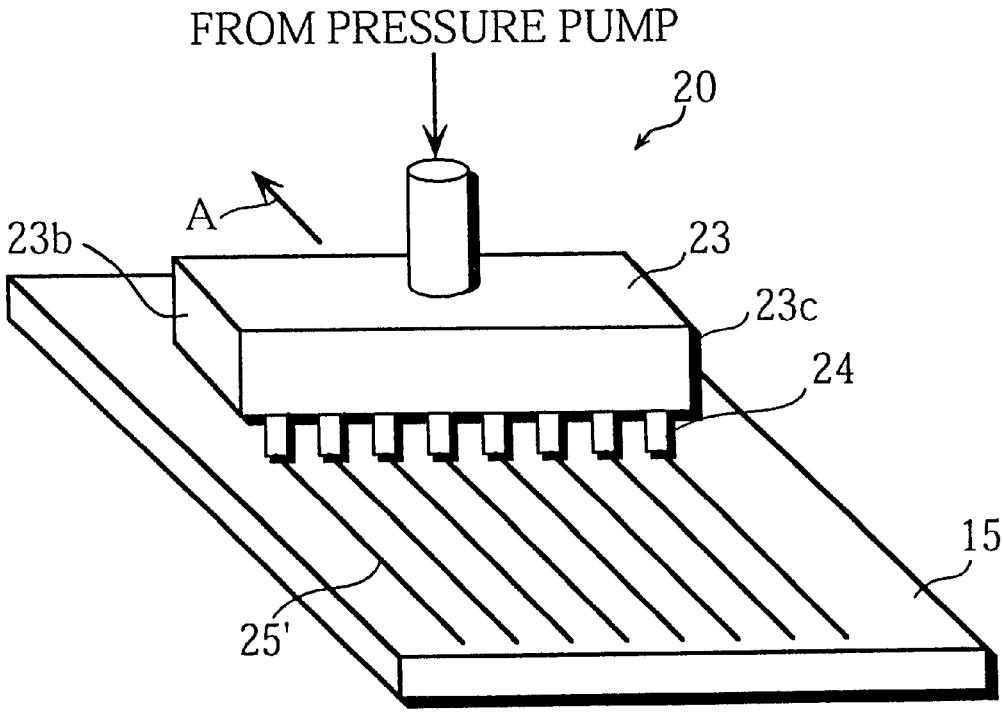
FIG. 5 is a perspective illustration showing an ink application by an ink applying apparatus of the present invention.

Ink applying apparatus 20 may be designed to include header 23 having a plurality of nozzles, as shown in FIG. 5. The ink is continuously spouted out from the nozzles in parallel while header 23 runs above the surface. Arrow "A" indicates the running direction of header 23. It is possible for nozzle 24 with such construction to apply the ink onto the surface forming a plurality of lines 26 at one time.

In this way, discharge electrodes 12 are formed by allowing ink applying apparatus 20 to apply the electrode material ink onto front glass substrate 11, and address electrode 16 is formed by allowing ink applying apparatus 20 to apply the electrode material ink onto back glass substrate 15.

Discharge electrodes 12 and address electrode 16 are baked with dielectrics glass layer 13 and partition walls 17.

Ink applying apparatus 20 applies the fluorescent substance ink for each color of red, blue, and green onto back glass substrate 15 along partition walls 17. The fluorescent substance ink applied onto the surface of the channel between partition walls 17 is dried, then the panels are baked for 10 minutes at about 500° C., resulting in fluorescent substance layer 18.

With the above construction, ink is continuously applied, resulting in fluorescent substance layer 18 with an even layer thickness, while conventional ink jet methods apply ink in liquid drops, resulting in an uneven layer.

Ink applying apparatus 20 may also be designed to include header 23 having three ink chambers and nozzles respectively for three colors of red, blue, and green. With this construction, the fluorescent substance ink for each color of red, blue, and green is spouted out in parallel, enabling application of fluorescent substance ink for each of the three colors at one time.

Samples 1–5

PDP Samples 1–5 were produced based on Embodiment 1.

Table 1 shows compositional ratios, viscosities, and panel brightness of each of the Ag ink (electrode material ink) and the fluorescent substance ink used in Samples 1–5.

In Samples 1–5, $BaMgAl_{10}O_{17}:Eu^{2+}$ is used as the blue fluorescent substance, $Zn_2SiO:Mn$ as the green fluorescent substance, and $(Y_xGd_{1-x})BO_3:Eu^{3+}$ as red fluorescent substance.

In Table 1, the electrode material ink (Ag ink) is composed of 70% by weight of lead oxide (PbO), 15% by weight of silicon oxide ($SiO_2$), and 15% by weight of boron oxide ($B_2O_3$). The molecular weight of ethyl cellulose used as the binder is 200,000. The molecular weight of acrylic resin is 100,000.

In Sample 1, discharge electrodes 12 and address electrode 16 respectively with electrode width 60 $\mu$m were formed by allowing the electrode material ink to be spouted out from 50 $\mu$m-aperture nozzles while running, by keeping the distance between the front-end of the nozzles and the back glass substrate at 1 mm.

The distance between partition walls 17 (cell pitch) was set to 0.15 mm, the height of partition walls 17 to 0.15 mm.

Neon (Ne) gas containing 10% Xenon (Xe) gas was used as the discharge gas. The charging pressure was set to 500 Torr.

In Samples 2–5, discharge electrodes 12 and address electrode 16 respectively with electrode width 50 $\mu$m were formed by allowing the electrode material ink to be spouted out from 45 $\mu$m-aperture nozzles.

The distance between partition walls 17 (cell pitch) was set to 0.106 mm, the height of partition walls 17 to 0.10 mm.

Neon (Ne) gas containing 20% Xenon (Xe) gas was used as the discharge gas. The charging pressure was set to 600 Torr.

The brightness was measured for each of Sample PDPs 1–5 after discharging them with 150V discharge maintenance voltage and 30 KHz frequency. Note that this condition for measuring the brightness is also used in the rest of the Samples.

The wavelength of the ultraviolet ray was an excitation wavelength of molecular beams of Xe, mainly at 173 nm. The results of the brightness measurement are shown in Table 1.

Embodiment 2

The structure and production method of PDPs of Embodiment 2 are the same as Embodiment 1, although the method of producing the fluorescent substance layer differs from that of Embodiment 1. The following is a description of a method of forming a fluorescent substance layer on the surfaces of the channels between the partition walls on back glass substrate 15.

Figure 6:
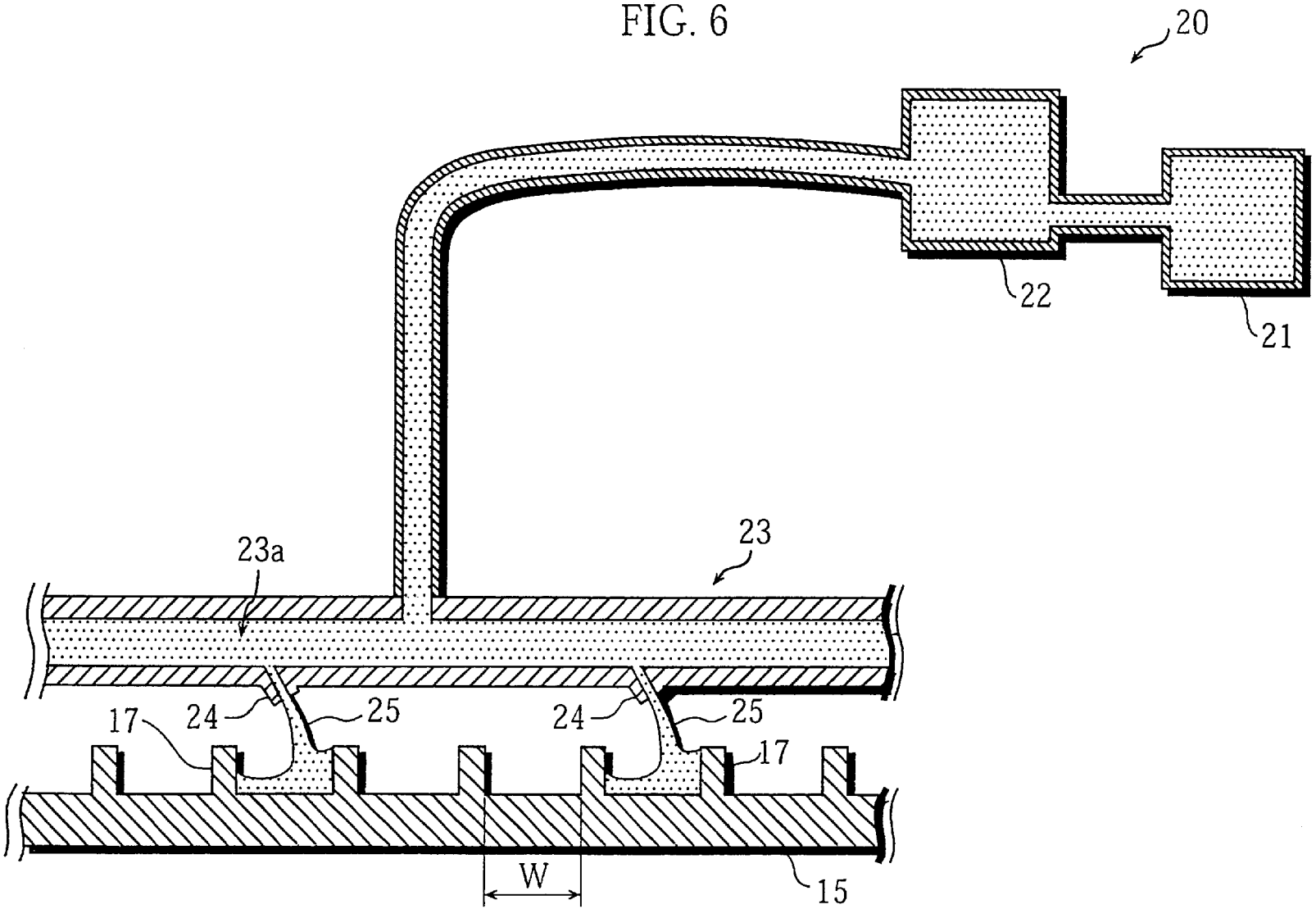
FIG. 6 is a schematic illustration of the ink applying apparatus of Embodiment 2 used for forming the fluorescent substance layer.
Figure 7:
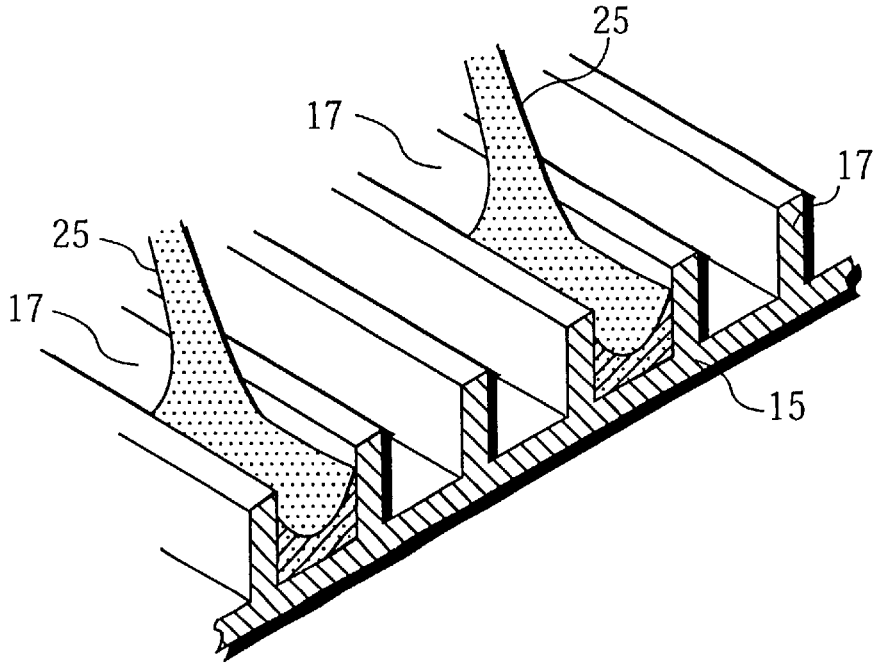
FIG. 7 is a partially enlarged perspective illustration showing the application of ink by the ink applying apparatus shown in FIG. 5.

FIG. 6 is a schematic illustration of ink applying apparatus 20 of Embodiment 2 used for forming fluorescent substance layer 18. FIG. 7 is a partially enlarged perspective illustration showing the application of ink.

Ink applying apparatus 20 shown in FIG. 6 is an equivalent of ink applying apparatus 20 in Embodiment 1. Server 21 stores the fluorescent substance ink. Pressure pump 22 puts pressure upon the fluorescent substance ink and supplies the ink to header 23. header 23 includes ink chamber 23*a* and a plurality of nozzles 24. With this construction, the ink is continuously spouted out from nozzles 24.

Nozzles 24 of Embodiment 2, however, are not perpendicular to the bottom of partition walls 17, but are slanted in the direction of one side of partition walls 17, as shown in FIGS. 6 and 7. The angle of tilt is represented as θ in FIG. 8A. With this tilt of the nozzles, ink flow 25 which is spouted out from each of nozzles 24 bumps into one side of each of partition walls 17, not into the center of the bottom.

The above construction of Embodiment 2 generates an effect that the fluorescent substance ink is applied onto the side of partition walls 17 as well as onto the bottom of the channel between partition walls 17, forming fluorescent substance layer 18 which has larger light emission area than Embodiment 1. It is needless to say that the ink is applied evenly in lines, in the same manner as Embodiment 1.

The operation and effect of ink applying apparatus 20 are described in detail with reference to FIGS. 5–8.

Ink applying apparatus 20 includes header 23 for each color, namely, red, blue, and green. The pitch of each of nozzles 24 is set to three times the cell pitch. As shown in FIGS. 6 and 7, each header 23 applies the fluorescent substance ink onto every three channels between partition walls 17 while running.

It is possible to apply the fluorescent substance ink onto both sides of partition walls 17 by first applying the ink while running in the direction of "A" as shown in FIG. 5, then applying the ink again while running in the direction of "A" after turning header 23 so that end 23*b* and end 23*c* replace with each other. This is also achieved by applying the ink while running in the reverse direction after turning header 23.

Figure 8A:
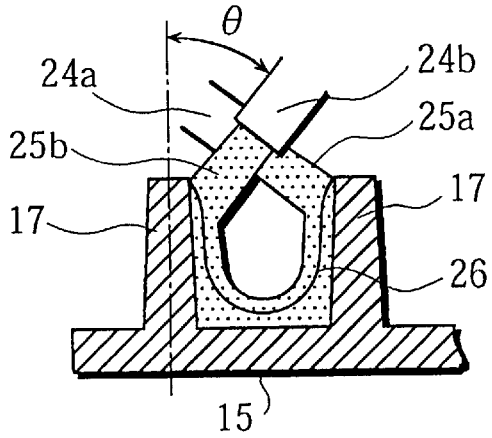
FIGS. 8A and 8B show the effect of the method of Embodiment 2 for applying the fluorescent substance ink.
Figure 8B:
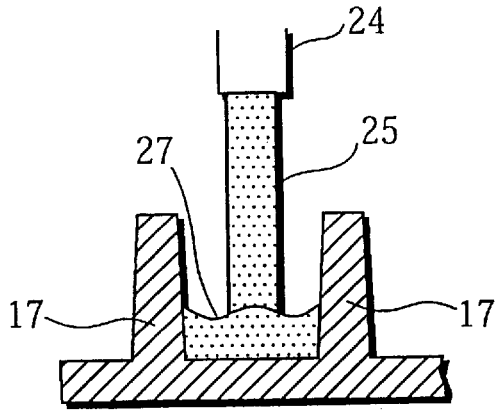

FIGS. 8A and 8B show the effect of the method of the present Embodiment for applying the fluorescent substance ink.

24*a* in FIG. 8A indicates a position of a nozzle 24 in the first application of ink, and 25*a* a continuous ink flow formed by the nozzle 24. 24*b* in FIG. 8A indicates a position of a nozzle 24 in the second application of ink, and 25*b* a continuous ink flow formed by the nozzle 24.

Ink flows 25*a* and 25*b* are respectively slanted from a line perpendicular to back glass substrate 15 in the direction of either of two sides of partition walls 17 with angle θ. With this tilt, ink flows 25*a* and 25*b* first bump into either of two sides of partition walls 17 then flow onto the bottom of the channel between partition walls 17. This method enables applying of the ink up to the upper part of both sides of partition walls 17. The solid line 26 in FIG. 8A indicates the surface of the fluorescent substance ink formed in the channel between partition walls 17.

FIG. 8B, in contrast, shows an application of ink in which ink flow 25*a* is perpendicular to back glass substrate 15, bumping into the center of the channel between partition walls 17. With this method, it is difficult to fully apply the ink onto both sides of partition walls 17. The solid line 27 in FIG. 8B indicates the surface of the fluorescent substance ink formed in the channel between partition walls 17 with this method.

Header 23 of ink applying apparatus 20 of the present Embodiment may have two nozzles 24 set in the direction of two sides of partition walls 17 respectively so that the ink is spouted out from the two nozzles in parallel. This construction enables applying of the fluorescent substance ink onto the both sides of partition walls 17 at a time.

Table 2 shows compositional ratios, viscosities, and panel brightness of each of the Ag ink (electrode material ink) and the fluorescent substance ink used in Samples 6–13.

In Samples 6–13, as in Samples 1–5, $BaMgAl_{10}O_{17}:Eu^{2+}$ is used as the blue fluorescent substance, $Zn_2SiO_4$:Mn as the green fluorescent substance, and $(Y_xGd_{1-x})BO:Eu^{3+}$ as red fluorescent substance.

Sample 6

PDP Samples 6 was produced based on Embodiment 2, using the Ag ink (electrode material ink) and the fluorescent substance ink of index No. 6 shown in Table 2.

Neon (Ne) gas containing 5% Xenon (Xe) gas was used as the discharge gas. The charging pressure was set to 500 Torr. The wavelength of the ultraviolet ray was an excitation wavelength of molecular beams of Xe, mainly at 173 nm. The results of the brightness measurement are shown in Table 2.

Embodiment 3

The structure and production method of PDPs of Embodiment 3 are the same as Embodiment 1, although the method of producing the fluorescent substance layer differs from that of Embodiment 1. The following is a description of a method of forming a fluorescent substance layer on the surfaces of the channels between the partition walls on back glass substrate 15.

Figure 9:
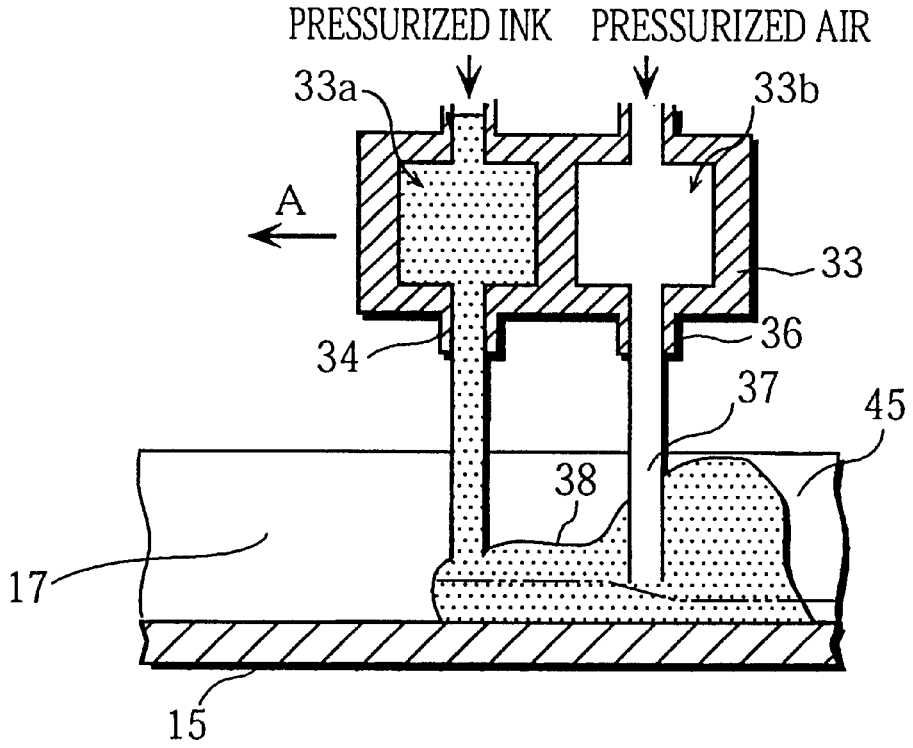
FIG. 9 is a schematic illustration of the method of Embodiment 3 for applying the fluorescent substance ink.

FIG. 9 is a schematic illustration of the ink application method of Embodiment 3, showing a sectional view of back glass substrate 15 and the header which tuns along partition walls 17 in the direction indicated by arrow "A."

The ink applying apparatus of Embodiment 3 is an equivalent of ink applying apparatus 20 in Embodiment 1, except the following. Header 33 includes air chamber 33*b* and a plurality of air nozzles 36, as well as ink chamber 33*a* and a plurality of nozzles 34. Compressed air is supplied from a compressor (not shown in the drawings) to air chamber 33*b*.

A plurality of air nozzles 36 are respectively formed behind a plurality of nozzles 34 in the running direction of header 33.

Figure 10A:
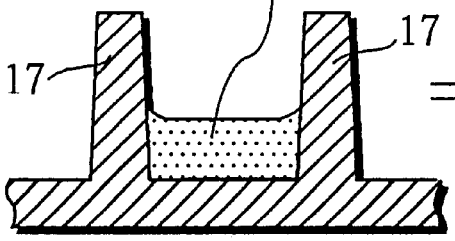
FIGS. 10A and 10B are schematic illustrations of the method of Embodiment 3 for applying the fluorescent substance ink.
Figure 10B:
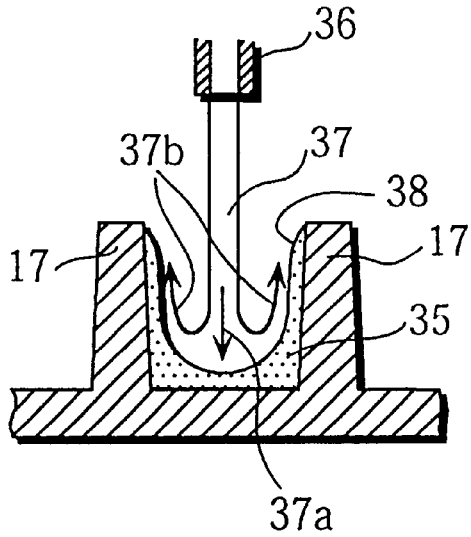

With such a construction, the fluorescent substance ink spouted out from a nozzle 34 forms a continuous ink flow which is applied onto the surface of the channel between the partition walls (see FIG. 10A). Air flow 37 spouted out from an air nozzle 36 puts pressure upon the fluorescent substance ink and pushes the ink aside to both sides immediately after the ink is applied on the center of the channel (see arrow 37*a* in FIG. 10B). At the same time, the air flow 37 flows along liquid surface 38 of the fluorescent substance ink (see arrow 37*b* in FIG. 10B), which lets the fluorescent substance ink stand along partition walls 17.

The air flow 37 also dries the fluorescent substance ink 35 when letting the ink stand along partition walls 17. As a result, the fluorescent substance ink 35 is fixed on the sides of partition walls 17, which makes it easy to form the fluorescent substance layer on the sides of the partition walls.

The width of air flow 37 is set to a value smaller than the width between the partition walls. The amount of movement of the air flow can be arranged based on the application amount of the fluorescent substance ink or the wettability of the ink against the partition walls.

Heated compressed air may be supplied to air chamber 33*b* of the ink applying apparatus of the present Embodiment so that the heated air is spouted out from air nozzles 36. This enhances the power of the air flow in drying the fluorescent substance ink, increasing the amount of the fluorescent substance formed on the sides of the partition walls.

Sample 7

PDP Samples 7 was produced based on Embodiment 3, using the Ag ink (electrode material ink) and the fluorescent substance ink of index No. 7 shown in Table 2.

Neon (Ne) gas containing 6% Xenon (Xe) gas was used as the discharge gas. The charging pressure was set to 500 Torr. The wavelength of the ultraviolet ray was an excitation wavelength of molecular beams of Xe, mainly at 173 nm. The results of the brightness measurement are shown in Table 2.

Embodiment 4

The structure and production method of PDPs of Embodiment 4 are the same as Embodiment 3, although an external force other than the air flow is put upon the fluorescent substance ink to let the ink stand along the partition walls.

Figure 11:
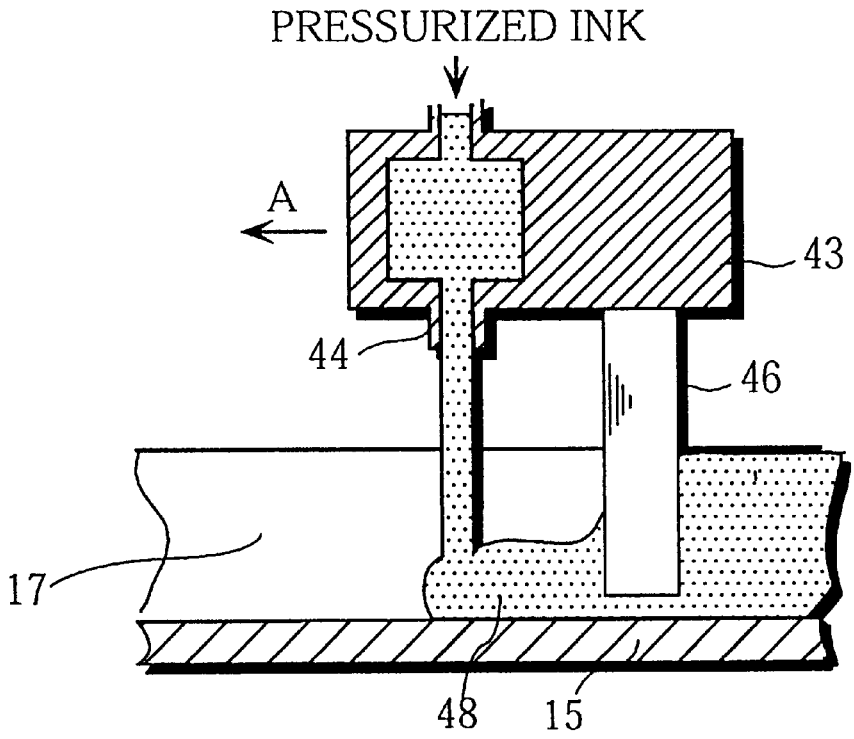
FIG. 11 is a schematic illustration of the method of Embodiment 4 for applying the fluorescent substance ink.

As shown in FIG. 11, header 43 includes a plurality of ink stirring rods 46 immediately behind a plurality of nozzles 44, respectively. Arrow "A" in the drawing indicates the movement direction.

With such a construction, the fluorescent substance ink 48 applied on the bottom of the channel is pushed aside to both sides of the partition walls. This method enables applying of the ink up to the upper part of both sides of the partition walls.

The depth of 46 below the surface of the ink or the like can be arranged based on the application amount of the fluorescent substance ink or the wettability of the ink against the partition walls.

The same effect can be achieved by sinking a sustained wire (not shown in the drawings) into each channel after the fluorescent substance ink is supplied to the channel so that the fluorescent substance ink applied on the bottom of the channel is pushed aside to both sides of the partition walls.

The same effect will also be achieved by other methods, such as shaking the back glass substrate after the fluorescent substance ink is supplied to the channel so that the ink stands along the sides of the partition walls, or flipping the back glass substrate vertically after the fluorescent substance ink is supplied to the channel so that the ink flows down through the sides of the walls by gravity.

In Embodiments 2–4 described above, the back glass substrate can be heated while the fluorescent substance layer is formed. This method accelerates the formation of the fluorescent substance layer on the sides of the partition walls since the solvent in the fluorescent substance ink evaporates fast and the fluidity of the ink is lost. In this case, it is desirable that the temperature of the back glass substrate does not exceed 200° C.

Embodiment 5

The structure and production method of PDPs of Embodiment 5 are the same as Embodiment 1, although the applied fluorescent substance ink forms a bridge between the sides of the partition walls while the nozzles run.

Figure 12:
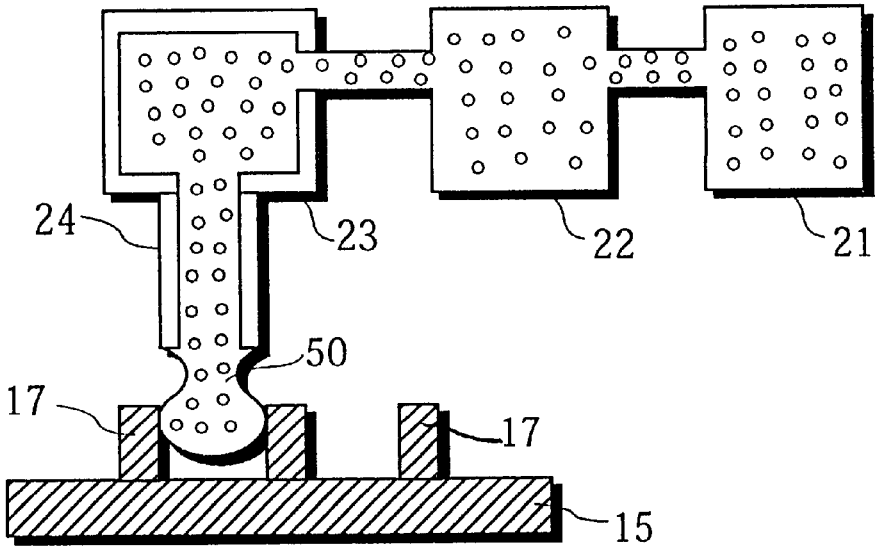
FIG. 12 is a sectional view of the application of the fluorescent substance ink by the ink applying apparatus of Embodiment 5.

FIG. 12 is a sectional view of the application of the fluorescent substance ink by the ink applying apparatus of the present Embodiment.

The construction of the ink applying apparatus of the present Embodiment is the same as ink applying apparatus 20 shown in FIG. 4. In the present Embodiment, however, fluorescent substance ink 50 spouted out from nozzles 24 forms a bridge between the sides of the partition walls by the surface tension while the nozzles run.

To maintain the state of the ink forming a bridge by the surface tension, it is necessary to keep an appropriate distance between the front-end of the nozzles 24 and the back glass substrate.

A stable application of ink is obtained by setting the distance to the range of 5 $\mu$m to 1 mm.

It is desirable that the aperture of nozzles 24 is set to the range of 45–150 $\mu$m, though the optimal value varies depending on the distance between the partition walls and the amount of the applied ink.

With the above construction, a stable continuous application of the fluorescent substance ink is obtained regardless of the speed of the nozzles. This indicates that expensive apparatuses with nozzles running at high speed are not required for forming the continuous flow of the ink since it can also be achieved by the nozzles running at low speed.

Accordingly, it is possible to achieve an even application of ink using a low-cost ink applying apparatus.

The present method also enables applying of the ink up to the upper part of both sides of the partition walls.

The same fluorescent substance ink as that used in Embodiment 1 can be used for the present Embodiment. However, it should be noted that it is generally difficult to form a continuous flow when a fluorescent substance ink with high viscosity or high surface tension is used, while the present method enables it.

Accordingly, the present method provides a lot of options for the material used as the fluorescent substance ink since this method decreases the limitation of the viscosity and the surface tension of the ink.

Note that the present method is also achieved by using header 23 including a plurality of nozzles 24 as shown in FIG. 5.

The ink applying apparatus used for the present method may also be designed to include header 23 having three ink chambers and nozzles respectively for three colors of red, blue, and green. With this construction, the fluorescent substance ink for each color of red, blue, and green is spouted out in parallel, enabling application of fluorescent substance ink for each of the three colors at one time.

To achieve a stable continuous application of the fluorescent substance ink with this method, it is necessary to form a bridge between the front-end of each nozzle and the sides of the partition walls without fail as the nozzles start to run. For achieving this, the following methods may be adopted.

(1) To temporarily stop the nozzles at the end of the partition walls and let out a certain amount of ink to form a bridge between the front-end of each nozzle and the sides of the partition walls before the nozzles start running.

(2) To let out a certain amount of ink at the end of the partition walls with shorter distance between the front-end of each nozzle and back glass substrate 15 than that during the movement of the nozzles to form a bridge between the front-end of each nozzle and the sides of the partition walls before the nozzles start running.

Figure 13:
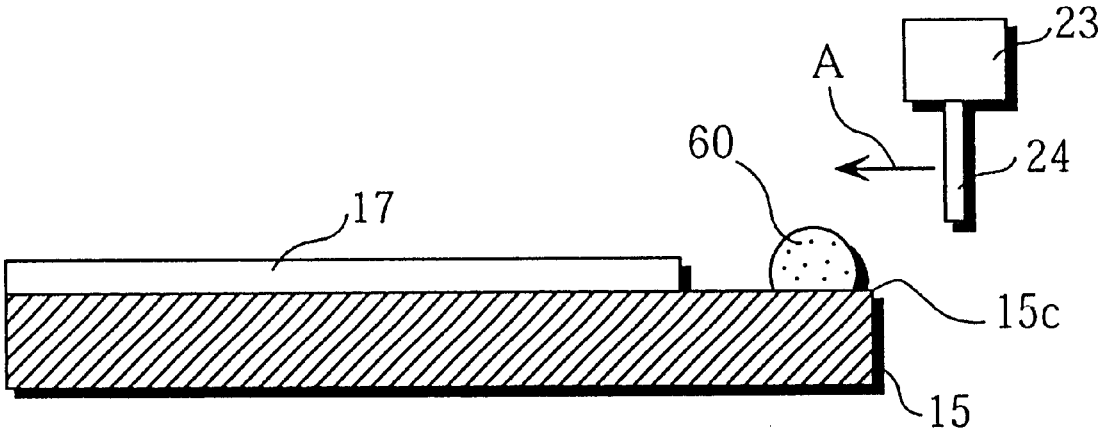
FIG. 13 shows a method of Embodiment 5 for forming a bridge with the ink.

(3) First, ink 60 is applied at end 15*c* of back glass substrate 15 in advance, as shown in FIG. 13. For applying ink 60 at end 15*c*, an independent unit in the ink applying apparatus may be used, or nozzles 24 may be positioned at end 15*c* for applying ink, or another apparatus or tool may be used for applying ink 60 at end 15*c* in advance before back glass substrate 15 is loaded into the ink applying apparatus.

Then, the front-end of each nozzle is dipped into the ink 60 to form a bridge between the front-end of each nozzle and the sides of the partition walls. Then, the nozzles run while continuously letting out the ink. With such a method, it is possible to form a bridge and apply the ink in succession.

Sample 8

PDP Samples 8 was produced based on Embodiment 5, using the Ag ink (electrode material ink) and the fluorescent substance ink of index No. 8 shown in Table 2.

The viscosity of the fluorescent substance ink is set to the range of 10–1000 cP at 25° C. The aperture of nozzle is set to 80 $\mu$m. Under this condition, first, the fluorescent substance ink was spouted out from the nozzles to form a bridge between the front-end of each nozzle and the sides of the partition walls 17 by putting pressure of 0.5 kgf/cm$^2$. Then, the fluorescent substance ink was continuously applied onto the channel between the partition walls when the header runs at 50 mm/s of speed above back glass substrate 15 by keeping the distance between the front-end of the nozzle and the back plate at 100 $\mu$m.

Note that when the bridge is not formed first under the above condition, the fluorescent substance ink is not continuously applied onto the channel since a small amount of ink is spouted out from the nozzles.

The fluorescent substance layer was formed after the fluorescent substance ink applied for each color was dried and then baked for 10 minutes at about 500° C.

Neon (Ne) gas containing 5% Xenon (Xe) gas was used as the discharge gas. The charging pressure was set to 500 Torr. The wavelength of the ultraviolet ray was an excitation wavelength of molecular beams of Xe, mainly at 173 nm. The results of the brightness measurement are shown in Table 2.

Embodiment 6

Figure 14:
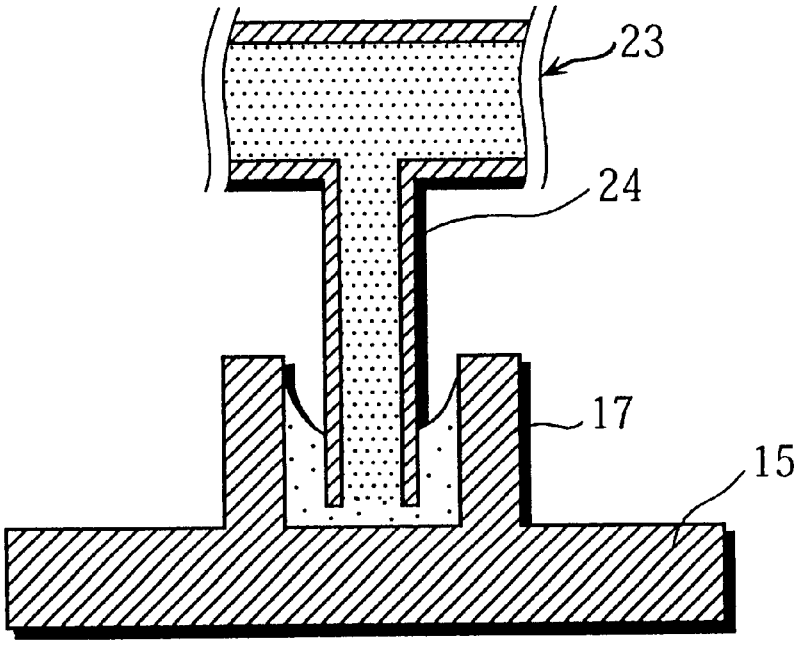
FIG. 14 is a sectional view of the application of the fluorescent substance ink by the ink applying apparatus of Embodiment 6.

FIG. 14 is a sectional view of the application of the fluorescent substance ink by the ink applying apparatus of the present Embodiment.

Embodiment 6 is almost the same as Embodiment 5 except that the fluorescent substance ink is spouted out from a nozzle 24 forming the bridge while the nozzle is inserted in each channel between the partition walls.

With the above construction, the ink is applied evenly onto the channel, forming the bridge between the sides of the partition walls.

Moreover, the ink is applied up to the upper part of both sides of the partition walls since the nozzle 24 pushes aside the ink applied on the center of the channel to both sides, which makes it easy to form the fluorescent substance layer on the sides of the partition walls.

It is needless to say that the outside diameter of the nozzle 24 is smaller than the distance between the sides of the partition walls. The depth of nozzle 24 below the surface of the ink or the like can be arranged based on the application amount of the fluorescent substance ink, ink characteristic, or the wettability of the ink against the partition walls.

Sample 9

PDP Samples 9 was produced based on Embodiment 6, using the Ag ink (electrode material ink) and the fluorescent substance ink of index No. 9 shown in Table 2.

The height of the partition walls was set to 120 $\mu$m.

The distance between the front-end of the nozzle and back glass substrate 15 was set to 20 $\mu$m.

The viscosity of the fluorescent substance ink was set to the range of 10–1000 cP at 25° C.

Neon (Ne) gas containing 10% Xenon (Xe) gas was used as the discharge gas. The charging pressure was set to 500 Torr. The wavelength of the ultraviolet ray was an excitation wavelength of molecular beams of Xe, mainly at 173 nm. The results of the brightness measurement are shown in Table 2.

Embodiment 7

The structure and production method of PDPs of Embodiment 7 are the same as Embodiment 1, although partition walls 17 and fluorescent substance layer 18 are formed with a different method.

That is, a material is selected for the partition walls 17 so that the contact angle of the fluorescent substance ink against the partition wall material is equal to or smaller than 90° and is smaller than the contact angle of the same ink against the channel bottom material. This arrangement makes it easy for the fluorescent substance ink to stick to the sides of partition walls 17.

The partition walls 17 may be formed with the thermal spraying, as well as by the screen printing. The thermal spraying is described below.

FIGS. 15A–15F show a formation of the partition walls with the thermal spraying.

Figure 15A:
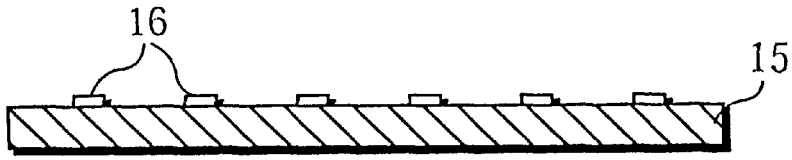
FIGS. 15A–15F show a formation of the partition walls with the thermal spraying.
Figure 15B:
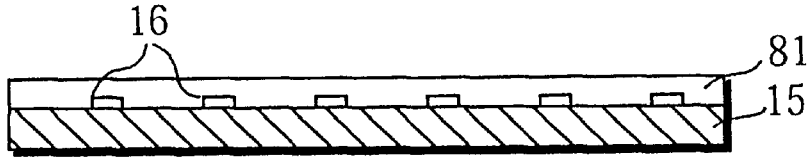

First, the surface of back glass substrate 15 on which address electrodes 16 are formed (FIG. 15A) is covered with dry film 81 which is made of acrylic photosensitive resin (FIG. 15B).

Figure 15C:
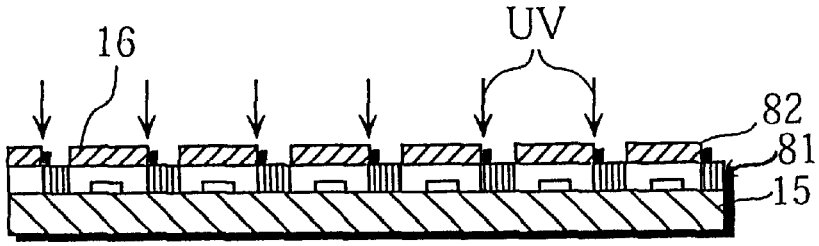
Figure 15D:
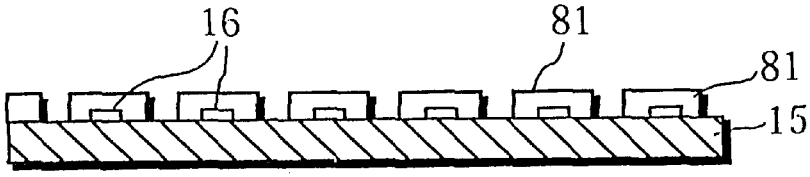
Figure 15E:
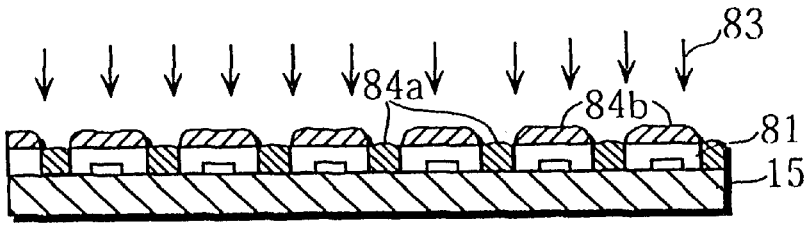

The dry film 81 is then cut with the photolithography. That is, photo masks 82 are covered on the dry film 81 so that the ultraviolet ray is shone onto the parts where the partition walls are to be formed (FIG. 15C). When back glass substrate 15 is developed, dry film 81 on the parts where the partition walls are to be formed are removed. Dry film 81 remains on the parts where the partition walls are not to be formed (FIG. 15D). Back glass substrate 15 is developed in around 1% alkaline solution (more specifically, sodium carbonate solution).

A mixture of alumina and glass which are the materials of the partition walls are sprayed onto the developed back glass substrate 15 with the plasma spraying.

Figure 16:
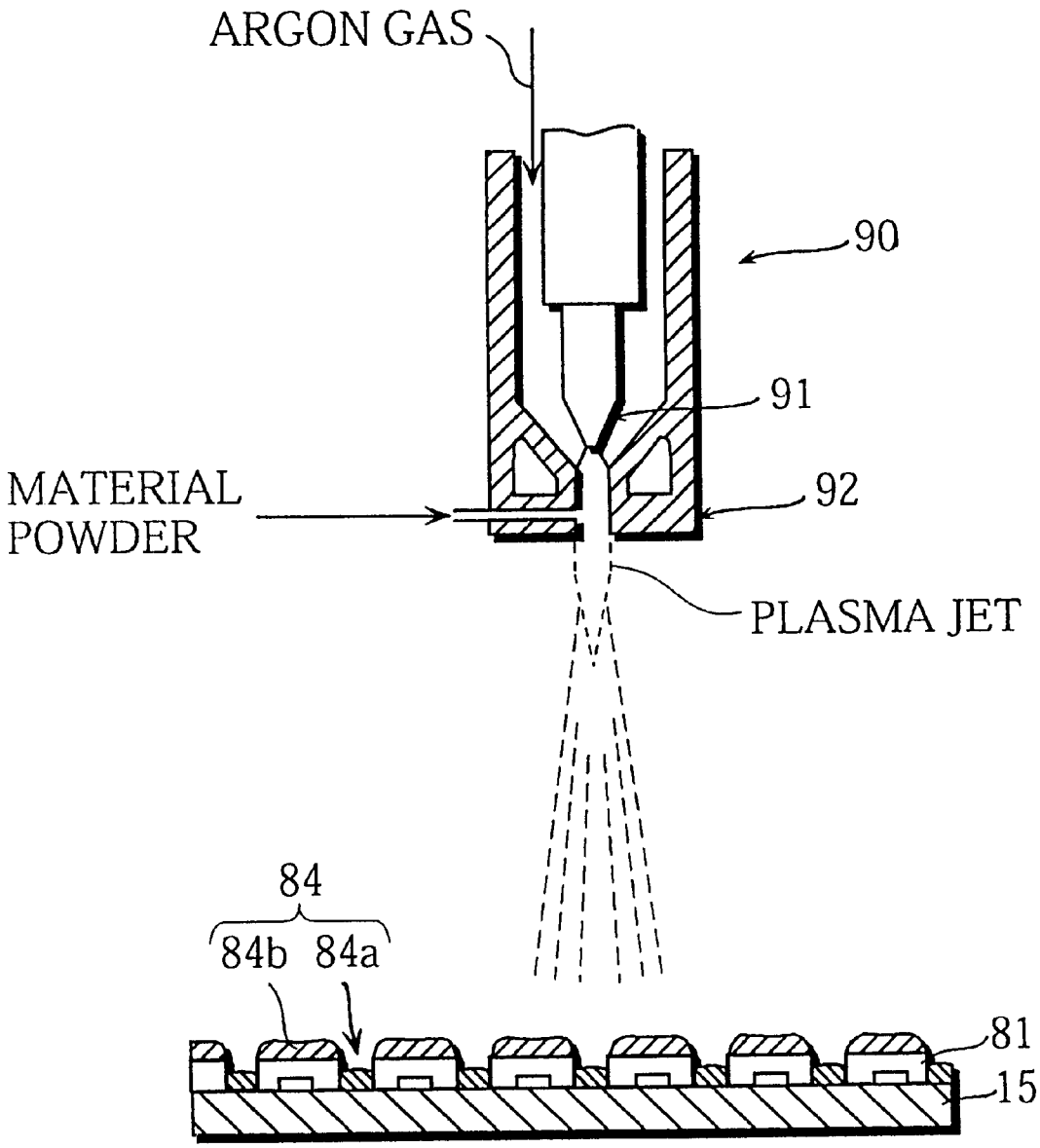
FIG. 16 shows the plasma spraying.

FIG. 16 shows the plasma spraying.

Plasma spraying apparatus 90 generates an ark discharge around the front-end of cathode 91 by applying the voltage to space between cathode 91 and anode 92, generates a plasma jet by sending argon gas into the ark discharge, and also sends the powder of the material (the mixture of alumina and glass) into the plasma jet. The material powder melts into the plasma jet. The plasma jet with the melted material is sprayed onto the surface of back glass substrate 15, forming a layer 84 of the material on the surface.

Figure 15F:
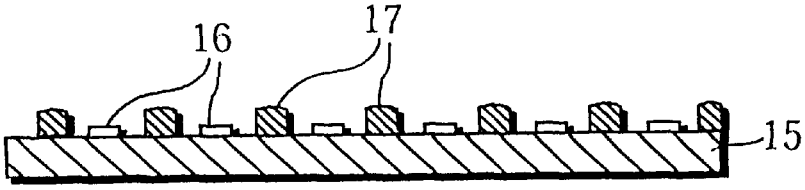

The back glass substrate 15 with layer 84 formed thereon (FIG. 15E) is soaked in a lift-off liquid (sodium hydroxide solution) to lift off the mask of dry film 81 (the lift-off method). In this process, 84*b* formed on the mask is together lifted off and 84*a* formed on back glass substrate 15 remains to form partition walls 17 (FIG. 15F).

The adsorption of a side 170*b* of partition walls 17 against the fluorescent substance ink (see FIG. 18A) is higher than the adsorption of a bottom 170*a* of the channel against the same when partition walls 17 is formed using a mixture of alumina and glass so that the contact angle of the fluorescent substance ink against partition walls 17 is smaller than the contact angle of the same ink against the back glass substrate 15. Note that alumina, zirconia, or a mixture of zirconia and glass may be used instead of the mixture of alumina and glass as the material of the partition walls to change the adsorption against the fluorescent substance ink.

Figure 17:
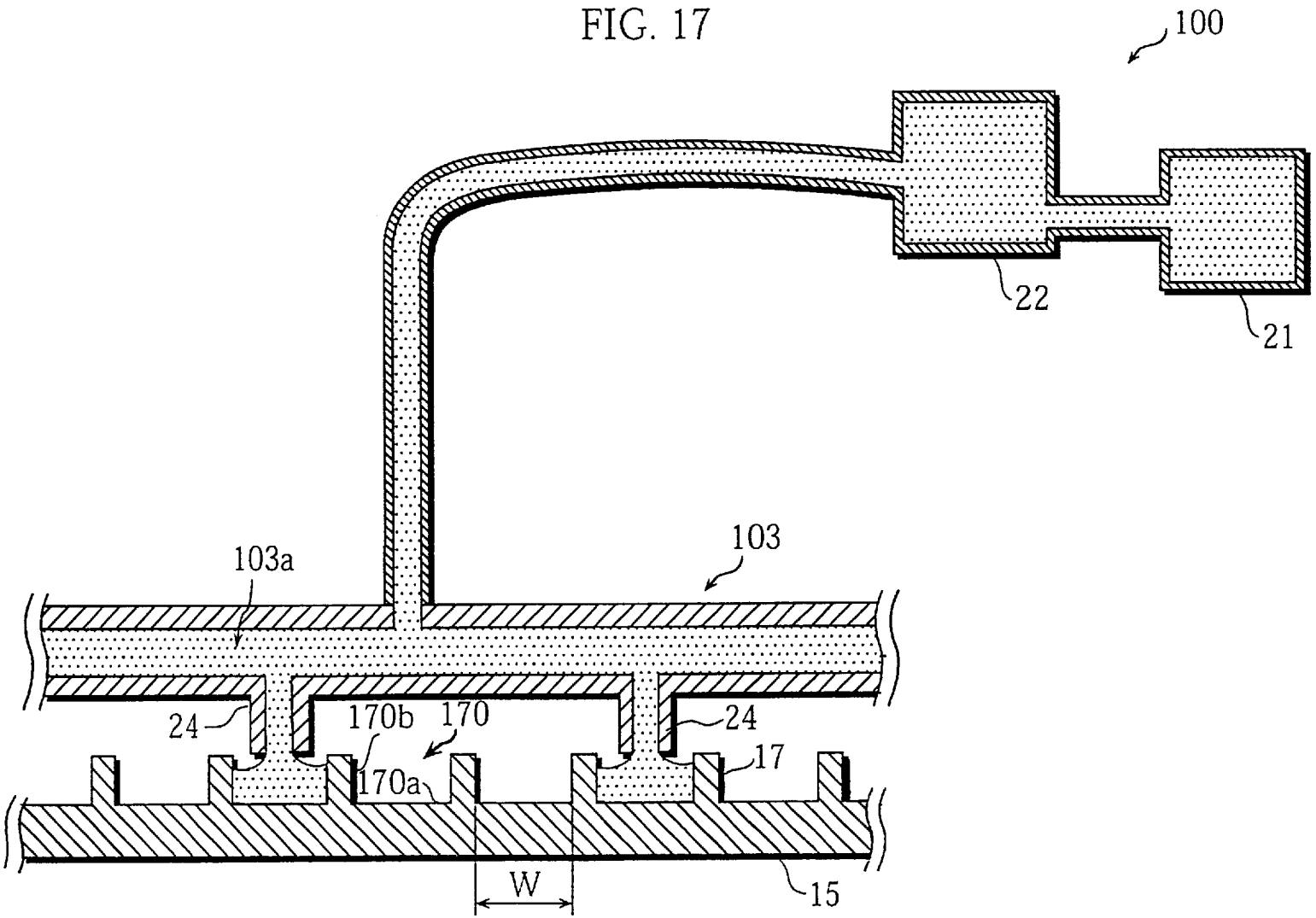
FIG. 17 is a schematic illustration of the ink applying apparatus of Embodiment 7.

FIG. 17 is a schematic illustration of ink applying apparatus 100 used for forming fluorescent substance layer 18.

Ink applying apparatus 100 shown in FIG. 17 is an equivalent of ink applying apparatus 20 shown in FIG. 4. Header 103 includes a plurality of nozzles 24. The fluorescent substance ink is supplied from ink chamber 103*a* to each nozzle 24. With this construction, the ink is continuously spouted out from nozzles 24.

In the present Embodiment, the same fluorescent substance ink as the one used in Embodiment 1 may be used. However, it is desirable to change its composition so that it is sticky against 170*b* of the channel. For this purpose, it is found that a relatively good result is obtained by using 0.1–10% by weight of ethyl cellulose as the binder, and terpineol ($C_{10}H_{18}O$) as the solvent.

Note that an organic solvent, such as diethylene glycol monomethyl ether, or water may also be used as the solvent. A polymer such as PMMA or poly(vinyl alcohol) may also be used as the binder.

The aperture of nozzle 24 is set to the range of 45–150 μm, the value, "45" being determined to prevent the nozzles from clogging up, and "150" being determined not to exceed the width W of the space between partition walls 17.

100 with the above construction is used to apply fluorescent substance ink by forming a bridge between nozzle 24 and the internal surfaces of the channel.

First, nozzles 24 are positioned at the end of back glass substrate 15 and the distance between each nozzle 24 and the internal surfaces of channel 170 is reduced enough or they are contacted with each other. Then, a little amount of the fluorescent substance ink is spouted out from each nozzle 24 to form a bridge by the surface tension of the fluorescent substance ink.

The fluorescent substance ink is then continuously applied onto the channel 170 formed on back glass substrate 15 by driving pressure pump 22 to allow each nozzle 24 to spout out the ink while running header 103. In this process, the distance between the front-end of the nozzle 24 and the bottom 170*a* is kept at 1 mm or less so that the bridge between nozzle 24 and the internal surfaces of the channel 170 is maintained.

It is desirable during operation that nozzles 24 and back glass substrate 15 do not touch each other. Since the surface of channel 170 on back glass substrate 15 has little bumps and dips, it is desirable to set the distance between the front-end of the nozzle 24 and the bottom 170*a* to 5 μm or more.

The pressure of pressure pump 22 during operation is adjusted based on the amount of ink to be applied and the movement speed of nozzle 24 so that an adequate amount of applied ink is spouted out.

In the present Embodiment, header 103 runs at a slow speed of several tens mm/s, and a small amount of ink is applied by setting the pressure of pressure pump 22 to a small value. With such an arrangement, a continuous flow of the fluorescent substance ink is formed and the ink is evenly applied onto the surface of channel 170, forming an even fluorescent substance layer.

It is desirable that the amount of fluorescent substance ink applied onto the channel 170 is set to 80% or more of the volume of the internal space of the channel 170 so that a great deal of the ink is applied onto the sides 170*b* of the channel 170. It is also desirable that the amount of the fluorescent substance contained in the fluorescent substance ink is set to the range of 20–60% by weight.

Effects

Figure 18A:
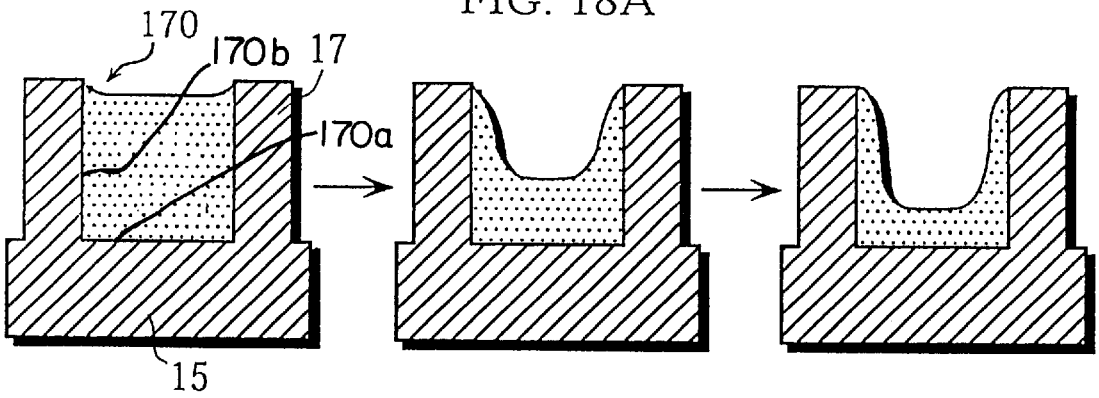
FIG. 18A is a schematic illustration showing the process of drying the ink applied onto the channel in Embodiment 8.

FIG. 18A is a schematic illustration showing the process of drying the ink applied onto the channel.

The ink remains on the sides 170*b* of the channel 170 without flowing down to the bottom during the above process of drying ink since the adsorption of a side 170*b* of partition walls 17 against the fluorescent substance ink is higher than the adsorption of a bottom 170*a* of the channel against the same.

The above effect is enhanced when the amount of fluorescent substance ink applied onto the channel 170 is set to 80% or more of the volume of the internal space of the channel 170, as shown in FIG. 18A.

Figure 18B:
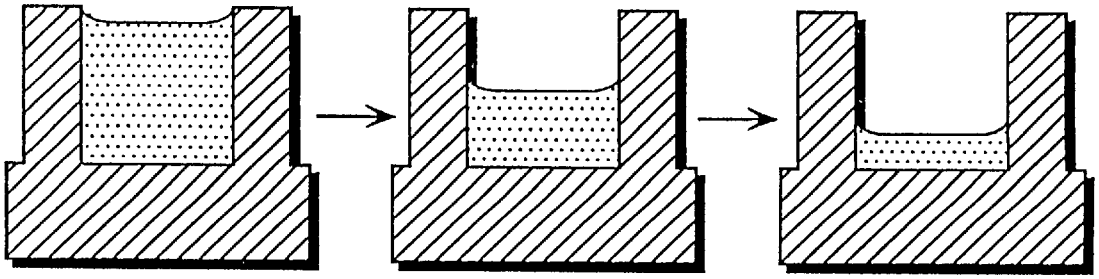
FIG. 18B is a schematic illustration used for comparison with FIG. 18A.

FIG. 18B, in contrast, is a schematic illustration showing the process of drying the ink applied on the channel when the adsorption of a side 170*b* of partition walls 17 against the fluorescent substance ink is lower than the adsorption of a bottom 170*a* of the channel against the same. In this case, as shown in the drawing, the ink tends to flow down to the bottom and not to remain on the sides of the partition walls.

As described above, with the PDP production method of the present Embodiment, the fluorescent substance ink is formed evenly along the partition walls and the ink is applied onto their sides, too. Accordingly, this method provides PDPs with high emission brightness.

Note that materials. for partition walls 17 are not limited to those described above. Any other materials may be used as far as the contact angle of the fluorescent substance ink against the partition wall material is smaller than the contact angle of the same ink against the channel bottom material. Here, it is desirable that the contact angle of the fluorescent substance ink against the partition wall material is equal to or smaller than 90° to make it easy for the fluorescent substance ink to stick to the sides of partition walls 17.

The adsorption of a material against the fluorescent substance ink changes depending on the surface roughness of the material as well as depending on the contact angle. That is, the greater the surface roughness of a material is, the higher the adsorption of the material against the ink is. Accordingly, the same effect may be obtained by setting the surface roughness of the material for channel sides greater than that of the material for channel bottom.

The surface roughness is adjusted by polishing the surface of back glass substrate 15 in advance so that its surface roughness becomes small, by controlling the conditions for the plasma spraying (e.g., flow amount of Argon gas, or applied voltage) in the formation of the partition walls with the thermal spraying, or by setting the baking temperature low in the formation of the partition walls with the screen printing so that their surface roughness becomes great.

The above effect becomes more noticeable when the contact angle of the fluorescent substance ink against the partition wall material is smaller than the contact angle of the same ink against the channel bottom material and when at the same time, the surface roughness of the material for channel sides is greater than that of the material for channel bottom.

The effect obtained by setting the adsorption of the sides of the channel against the fluorescent substance ink higher than the adsorption of the same against the bottom of the channel may be the same regardless of the ink applying method. That is, the fluorescent substance ink may be applied with a normal ink jet method or the screen printing instead of the ink application method of forming bridge.

Sample 10

PDP Samples 10 was produced based on Embodiment 7, using the Ag ink (electrode material ink) and the fluorescent substance ink of index No. 10 shown in Table 2.

The partition walls on the back panel was formed using a mixture of alumina and glass. The pitch, width, and height were respectively set to 140 $\mu$m, 30 $\mu$m, and 120 $\mu$m.

The contact angles of the fluorescent substance ink against the side 170*b* and bottom 170*a* of the partition walls were observed visually. The surface roughness was measured according to a method (Ten-Point Mean Roughness) defined in JIS (Japanese Industrial Standard) (JIS, Metal Surface Treatment, B 0601-1982).

The contact angles of the fluorescent substance ink against the side 170*b* was about 8°. The surface roughness of the side 170*b* was about 5 $\mu$m mean roughness. The contact angles of the fluorescent substance ink against the bottom 170*a* was about 13°. The surface roughness of the bottom 170*a* was about 0.5 $\mu$m mean roughness.

The aperture of nozzle 44 was set to 80 $\mu$m.

The distance between the front-end of the nozzle and the bottom was set to 100 $\mu$m. The fluorescent substance ink was spouted out from the nozzles by putting pressure of 0.5 kgf/cm$^2$ and by running the header at the speed of 50 mm/s so that the amount of fluorescent substance ink applied onto the channel is about 90% of the volume of the internal space of the channel.

The fluorescent substance layer was formed after the applied fluorescent substance ink was dried and then baked for 10 minutes at about 500° C.

Sections of the fluorescent substance layer were observed with a Scanning Electron Microscope (SEM) for each color. It was confirmed that the fluorescent substance layer had been formed evenly with mean thickness on the bottom about 20 $\mu$m, and mean thickness on the side about 25 $\mu$m.

Neon (Ne) gas containing 5% Xenon (Xe) gas was used as the discharge gas. The charging pressure was set to 800 Torr.

The wavelength of the ultraviolet ray was an excitation wavelength of molecular beams of Xe, mainly at 173 nm. The results of the brightness measurement are shown in Table 2.

Embodiment 8

The production method of PDPs of Embodiment 8 is the same as Embodiment 7, except that a film is formed on the bottom of the channel so that the contact angle of the fluorescent substance ink against the side of the partition walls is smaller than the contact angle of the same ink against the bottom of the channel.

Such a film is formed, for example, by melting fluororesin such as polytetrafluoroethylene at a high temperature and by applying the melted fluororesin onto back glass substrate 15 with the spin coat method. After this, address electrode 16 and partition walls 17 are formed on back glass substrate 15. This means the bottom of the channel is coated by the film.

When the fluorescent substance ink is applied on the surface of the above channel, a great deal of the fluorescent substance ink is applied onto the sides of the partition walls, as shown in FIG. 18A, since the contact angle of the fluorescent substance ink against the sides of the partition walls is smaller than the contact angle of the same against the bottom of the channel.

When back glass substrate 15 with the above applied ink is baked, a qualified fluorescent substance layer is formed on the sides and bottom of the channel. Note that when the film is made of an organic compound such as fluororesin, the film does not remain in the completed PDPs since the film is burned away when the fluorescent substance layer is baked.

In the present Embodiment, the ink jet method is used. However, the same effect may be obtained by using other ink application methods, such as the screen printing, as far as the contact angle of the fluorescent substance ink against the sides of the partition walls is smaller than the contact angle of the same against the bottom of the channel.

Embodiment 9

Figure 19:
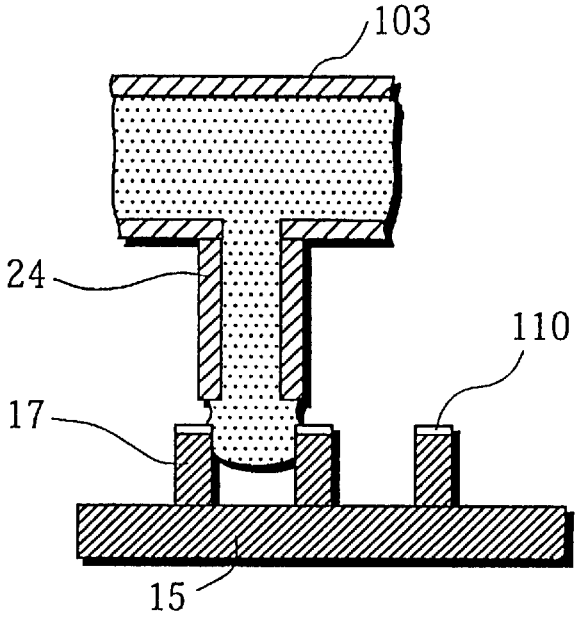
FIG. 19 is a sectional view of the application of the fluorescent substance ink by the ink applying apparatus of Embodiment 9.

FIG. 19 is a sectional view of the application of the fluorescent substance ink by the ink applying apparatus of the present Embodiment.

The production method of PDPs of Embodiment 9 is the same as Embodiment 7, except that before applying the fluorescent substance ink onto back glass substrate 15, a water-repellant film 110 is formed on the top of the partition walls so that the adsorption of the top of the partition walls is higher than that of their sides, as shown in FIG. 19.

The water-repellant film 110 is formed by applying a fluororesin such as polytetrafluoroethylene onto the top of the partition walls.

More specifically, in the procedure of forming the partition walls with the thermal spraying as described in Embodiment 7, after forming layer 84 on back glass substrate 15 (FIG. 15E), a melted fluororesin is applied onto the top of the partition walls with the spin coat method before lifting off the mask of dry film 81.

The fluorescent substance ink is prevented from sticking to the top of the partition walls when the adsorption of the top of the partition walls is higher than that of their sides.

This construction solves a problem that the fluorescent substances having stuck to the top of the partition walls become a hindrance in bonding the front panel and the back panel with a sealing glass. The water-repellant film 110 does not remain in the completed PDPs since the it is burned away when the fluorescent substance layer is baked.

As an alternative way for reducing the adsorption of the top of the partition walls, the top of the partition walls may be polished to reduce the surface roughness.

In the present Embodiment, the ink jet method is used. However, the same effect may be obtained by using other ink application methods, such as the screen printing, as far as the adsorption of the top of the partition walls is higher than that of their sides.

Sample 11

PDP Samples 11 was produced based on Embodiment 9, using the Ag ink (electrode material ink) and the fluorescent substance ink of index No. 11 shown in Table 2.

The partition walls on the back panel was formed using alumina. The pitch, width, and height were respectively set to 140 μm, 30 μm, and 120 μm. A water-repellant film of polytetrafluoroethylene was formed on the top of the partition walls.

The contact angles of the fluorescent substance ink against the side and the top water-repellant film of the partition walls were respectively about 5° and about 30°.

The aperture of nozzle was set to 100 μm.

The distance between the front-end of the nozzle and the bottom was set to 100 μm. The fluorescent substance ink was spouted out from the nozzles by putting pressure of 0.7 $kgf/cm^2$ and by running the header at the speed of 100 mm/s so that the amount of fluorescent substance ink applied onto the channel is about 90% of the volume of the internal space of the channel.

The fluorescent substance layer was formed after the applied fluorescent substance ink was dried and then baked for 10 minutes at about 500° C.

Sections of the fluorescent substance layer were observed with a Scanning Electron Microscope (SEM) for each color. It was confirmed that the fluorescent substance layer had been formed evenly with mean thickness on the bottom and the side about 20 μm.

In general, when such a nozzle with relatively great aperture is used, the ink tends to stick to the top of the partition walls. This was not observed in the present case of Embodiment 9. It is thought this is because the ink having stuck to the top of the partition walls moved to the sides as the ink was dried since the adsorption of the top of the partition walls is higher than that of their sides.

Neon (Ne) gas containing 5% Xenon (Xe) gas was used as the discharge gas. The charging pressure was set to 800 Torr.

It was confirmed that the fluorescent substance layer had been formed evenly without the ink remaining on top of the partition walls when the adsorption of the top was reduced by polishing it to reduce the surface roughness (the surface roughness of the side of the partition walls was about 5 μm, the surface roughness of the top was about 0.5 μm), instead of forming the water-repellant film.

Embodiment 10

The structure of the PDP of Embodiment 10 is the same as Embodiment 5, although the outer diameter of nozzles is set greater than the width of the space between the partition walls.

Figure 20:
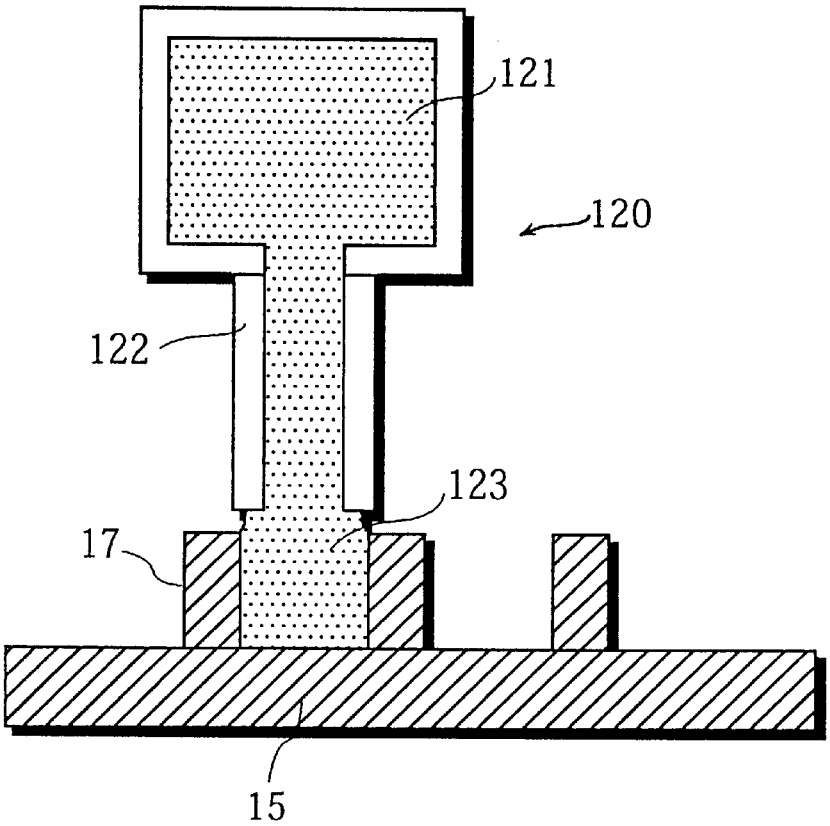
FIG. 20 is a sectional view of the application of the fluorescent substance ink by the ink applying apparatus of Embodiment 10.

FIG. 20 is a sectional view of the application of the fluorescent substance ink by the ink applying apparatus of the present Embodiment. The fluorescent substance ink is supplied to server 121 of ink applying apparatus 120 and is stirred so that the ink does not precipitate. The fluorescent substance ink is spouted out from nozzles 122 when it is pressed by a pressing means which is not shown in the drawings.

Server 121, driven by a driving mechanism (not shown in the drawings), runs along partition walls 17 on back glass substrate 15.

While server 121 runs, the fluorescent substance ink is spouted out from nozzles 122 and is applied onto the channel of the partition walls by forming a bridge between the internal surfaces of the channel.

The outer diameter of nozzles 122 is set greater than the width of the space between the partition walls and not to exceed the outer width of a pair of partition walls. With such a construction, the distance between partition walls 17 and nozzles 122 is relatively short. This makes it easier to form a bridge by the ink between the internal surfaces of the channel. Furthermore, even if a front-end of a nozzle touches the top of the partition walls due to deflection of back glass substrate 15 or the like, the opening of the nozzle is not closed.

To maintain the bridge formed between the internal surfaces of the channel, it is desirable to set the distance between partition walls 17 and the front-end of nozzles 122 to 1 mm or less.

Sample 12

PDP Samples 12 was produced based on Embodiment 10, using the Ag ink (electrode material ink) and the fluorescent substance ink of index No. 12 shown in Table 2.

The width of the space between partition walls 17 was set to 110 μm. The inside diameter of nozzles 122 was set to 80 μm, the outer diameter set to 120 μm. The distance between the top of partition walls 17 and the front-end of nozzles 122 during operation was set to 20 μm.

The fluorescent substance ink was mixed so that its viscosity at shear rate 200 sec-1 is in the range of 10–1000 cP. The ink was then supplied to server 121. Pressure 0.5 $kgf/cm^2$ was put on the server and the fluorescent substance ink 123 was spouted out from the nozzles 122 to form a bridge between the front-end of each nozzle and the sides of the partition walls 17.

Under the above condition, the fluorescent substance ink was continuously applied onto the channel between the partition walls when the header run at 50 mm/s of speed above back glass substrate 15.

Neon (Ne) gas containing 5% Xenon (Xe) gas was used as the discharge gas. The charging pressure was set to 500 Torr. The wavelength of the ultraviolet ray was an excitation wavelength of molecular beams of Xe, mainly at 173 nm. The results of the brightness measurement are shown in Table 2.

Embodiment 11

The structure of the PDP of Embodiment 11 is the same as Embodiment 5, although the shape of the front-end of nozzles differs.

Figure 21:
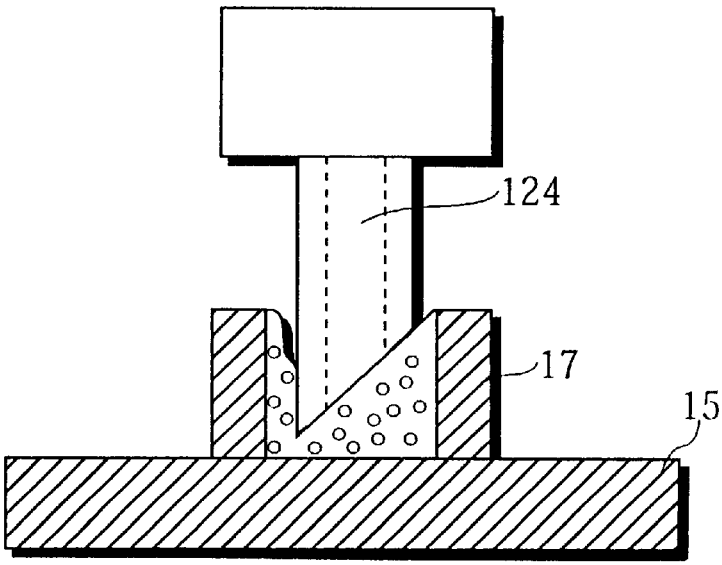
FIG. 21 is a sectional view of the application of the fluorescent substance ink by the ink applying apparatus of Embodiment 11.

FIG. 21 is a sectional view of the application of the fluorescent substance ink by the ink applying apparatus of the present Embodiment.

As shown in FIG. 21, the edge of the front-end of nozzle 124 is slant against the surface of back glass substrate 15.

With nozzles 124 having such a shape, the fluorescent substance is applied evenly, forming a bridge between the internal surfaces of the channel, in the same way as Embodiment 5.

To make it easy for the ink to form the bridge, the distance between the front-end of nozzles 124 and the surface of back glass substrate 15 is set to 1 mm or less.

When nozzles 124 run while they are inserted in the channels between the partition walls, the fluorescent substance ink applied on the bottom of the channels is pushed aside to both sides of the partition walls by the nozzles 124, making it easy for the fluorescent substance ink to stick to the sides.

With the slant shape of the front-edge of nozzles 124, the ink is applied continuously and steadily since the opening of the nozzles is not closed even if the front-end of the nozzles touch the surface of back glass substrate 15 during operation due to deflection of back glass substrate 15 or the like.

It is desirable to set the angle of inclination of the edge of nozzles 124 against the surface of back glass substrate 15 to the range of 10°–90°.

In the present Embodiment, the edge of the front-end of nozzle 124 is slant against the surface of back glass substrate 15. However, the same effect may be obtained by forming the edge of the front-end of nozzle 124 so that at least one part of the edge is distant from the surface of back glass substrate 15.

The following are Samples of such alternatives.

Figure 22:
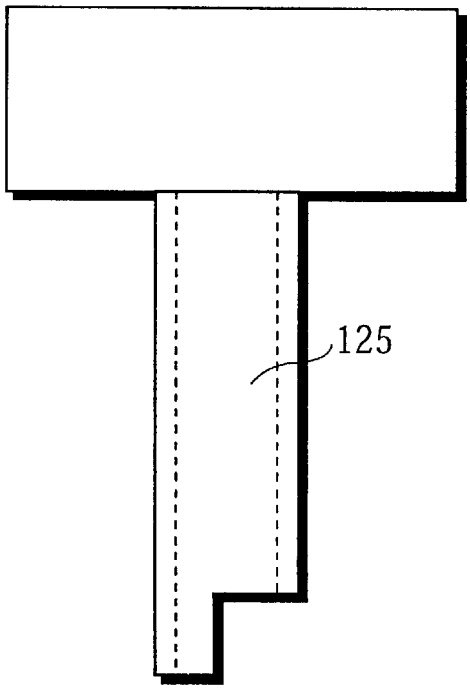
FIG. 22 shows a nozzle that may be used in embodiment 11.

Nozzle 125 shown in FIG. 22 whose edge is cut in a staircase shape.

Figure 23:
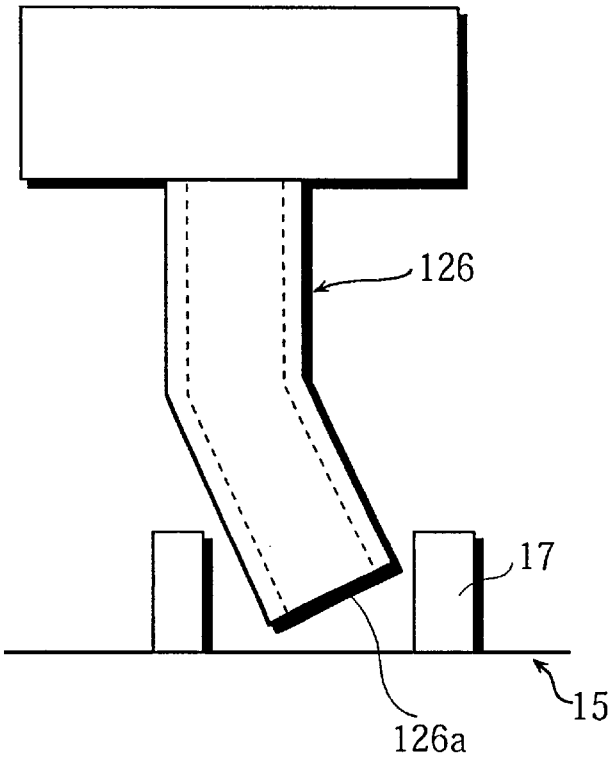
FIG. 23 shows another nozzle that may be used in the embodiment 11.

Nozzle 126 shown in FIG. 23 which is bent half way so that the opening 126*a* of the nozzle is slant against the surface of back glass substrate 15.

Figure 24:
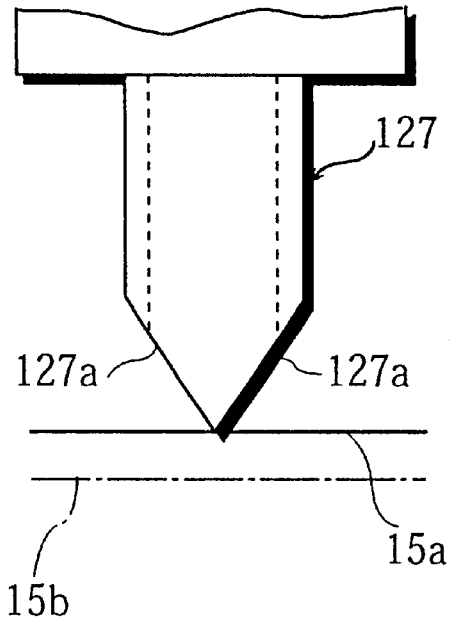
FIG. 24 shows still another nozzle that may be used in embodiment 11.

Nozzle 127 shown in FIG. 24 whose edge is cut in a V shape, having two openings 127*a*. Each of the openings 127*a* is slant against the surface (15*a*, 15*b*) of back glass substrate 15. In FIG. 24, surface 15*a* represented by the solid line touches the front-end of nozzle 127, while surface 15*b* represented by the alternate long and short dash line does not.

With any of the above nozzles 125–127, the ink is applied continuously and steadily even if the nozzle runs with its edge touching surface of back glass substrate 15 since the opening of the nozzles is not closed.

Sample 13

PDP Samples 13 was produced based on Embodiment 11, using the Ag ink (electrode material ink) and the fluorescent substance ink of index No. 13 shown in Table 2.

The width of the space between partition walls 17 was set to 110 μm. The inside diameter of nozzles 122 was set to 60 μm, the outer diameter set to 100 μm. The angle of inclination of the edge of nozzles 124 against the surface of back glass substrate 15 was set to 45°. The distance between the front-end of nozzles 124 and the surface of back glass substrate 15 was set to 20 μm.

Under the above condition, the fluorescent substance ink was continuously and steadily applied onto the channel between the partition walls.

Neon (Ne) gas containing 5% Xenon (Xe) gas was used as the discharge gas. The charging pressure was set to 500 Torr. The wavelength of the ultraviolet ray was an excitation wavelength of molecular beams of Xe, mainly at 173 nm. The results of the brightness measurement are shown in Table 2.

Embodiment 12

Figure 25:
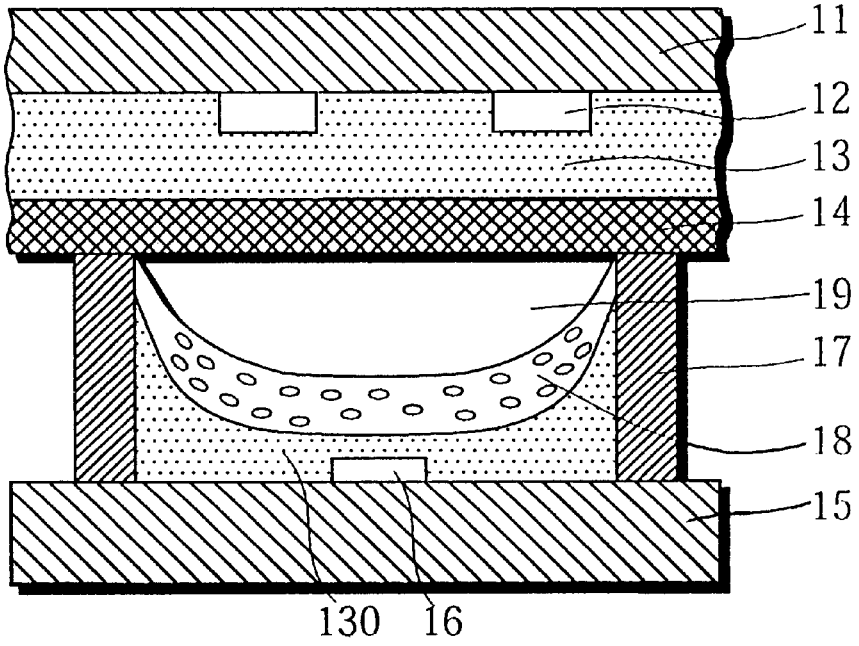
FIG. 25 is a sectional view of the PDP in Embodiment 12.

FIG. 25 is a sectional view of the application of the fluorescent substance ink by the ink applying apparatus of Embodiment 12. The structure and production method of PDPs of the present Embodiment are the same as Embodiment 1 (FIG. 2), although reflection layer 130 is formed under fluorescent substance layer 18. By forming reflection layer 130, the panel brightness is increased (10–20%).

The reflection layer 130 and fluorescent substance layer 18 are formed by applying the reflection material ink and the fluorescent substance ink using the ink applying apparatus shown in FIG. 4 for Embodiment 1 or the like.

The reflection material ink is composed of the reflection material, binder, and solvent. A white powder with high reflectance such as titanium oxide or alumina may be used as the reflection material. It is desirable to use titanium oxide with grain size 5 μm or less as the reflection material.

The methods of forming the fluorescent substance ink as shown in Embodiments 7 and 8 are applied to the formation of reflection layer 130 in the present Embodiment so that the adsorption of the sides of partition walls 17 against the fluorescent substance ink is higher than the adsorption of the bottom of the channel against the same.

That is to say, a material is selected for the partition walls 17 so that the contact angle of the fluorescent substance ink against the sides of the partition walls is smaller than the contact angle of the same ink against the bottom. Alternatively, for the same purpose, the surface roughness of the side of the partition walls is set higher than that of the bottom. This arrangement makes it easy for the reflection material ink to stick to the sides of partition walls 17 to increase PDP brightness, as described earlier with reference to FIG. 18A.

To make it easy for the reflection material ink to stick to the sides of the partition walls, it is desirable that 0.1–10% by weight of ethyl cellulose is used as the binder, and terpineol ($C_{10}H_{18}O$) as the solvent.

Note that an organic solvent, such as diethylene glycol monomethyl ether, or water may also be used as the solvent. A polymer such as PMMA or poly(vinyl alcohol) may also be used as the binder.

To keep the thickness of the reflection layer even, it is desirable that the viscosity of the ink is set low (1–1000 cP at 25° C.)

It is desirable that the amount of fluorescent substance ink applied onto the channel is set to 80% or more of the volume of the internal space of the channel so that a great deal of the ink is applied onto the sides of the channel. It is also desirable that the amount of the fluorescent substance contained in the fluorescent substance ink is set to the range of 20–60% by weight.

Table 3 shows compositional ratios, viscosities, and panel brightness of each of the Ag ink (electrode material ink) and the fluorescent substance ink used in Samples 14–17.

In Samples 14–17, $BaMgAl_{10}O_{17}:Eu^{2+}$ is used as the blue fluorescent substance, $Zn_2SiO_4:Mn$ as the green fluorescent substance, and $(Y_xGd_{1-x})BO_3:Eu^{3+}$ as red fluorescent substance.

Sample 14

PDP Samples 14 was produced based on Embodiment 12, using the Ag ink (electrode material ink) and the fluorescent substance ink of index No. 14 shown in Table 3.

The partition walls on the back panel was formed using a mixture of alumina and glass. The pitch, width, and height were respectively set to 140 μm, 30 μm, and 120 μm.

The reflection material ink contained 45% by weight of titanium oxide with mean grain size 3 μm as the reflection material, 1.8% by weight of ethyl cellulose as the binder, and 53.2% by weight of terpineol as the solvent. The viscosity of the reflection material ink was set to 50 cP at 20° C.

The contact angles of the reflection material ink against the sides of the partition walls was about 8°. The contact angles of the reflection material ink against the bottom of the partition walls (surface of back glass substrate 15) was about 13°.

The aperture of the nozzles was set to 80 μm.

The distance between the front-end of the nozzle and the surface of back glass substrate 15 was set to 100 μm. The reflection material ink was spouted out from the nozzles by putting pressure of 0.5 kgf/cm$^2$ and the bridge was formed. Then, the back glass substrate was moved in the direction along the partition walls while applying the reflection material ink continuously onto the surface of the channel between the partition walls so that the amount of reflection material ink applied onto the channel is about 90% of the volume of the internal space of the channel.

The reflection layer was formed after the applied reflection material ink was dried and then baked for 10 minutes at about 500° C.

Sections of the reflection layer were observed with a Scanning Electron Microscope (SEM). It was confirmed that the reflection layer had been formed evenly with mean thickness of about 20 μm on both the bottom and the sides.

The fluorescent substance layer was then formed on the reflection layer by applying the fluorescent substance ink on the reflection layer in the same way as the reflection layer.

Neon (Ne) gas containing 5% Xenon (Xe) gas was used as the discharge gas. The charging pressure was set to 500 Torr.

The wavelength of the ultraviolet ray was an excitation wavelength of molecular beams of Xe, mainly at 173 nm. The results of the brightness measurement are shown in Table 3.

Note that the reflection layer was also formed evenly with mean thickness of about 20 μm on the sides of the partition walls when the reflection material ink was applied onto the channels between the partition walls by setting the surface roughness of back glass substrate 15 to about 0.5 μm and by setting the surface roughness of glass partition walls to about 5 μm.

Embodiment 13

The structure of PDPs of the present Embodiment is the same as Embodiment 12 in which reflection layer 130 is formed (FIG. 25). The production method is also the same, although the adsorption of the top of partition walls 17 against the reflection material ink is set lower than the adsorption of the sides of partition walls 17 against the same.

The adjustment for the above purpose is made, as shown in FIG. 19 for Embodiment 9, by forming a water-repellant film 110 on the top of the partition walls so that the contact angle of the reflection material ink against the top of the partition walls is greater than the contact angle of the same ink against the sides.

The above purpose is also achieved by setting the surface roughness of the top of the partition walls lower than that of the sides.

With the above construction, it is not easy for the reflection material ink to stick to the top of the partition walls; even if it sticks, the reflection material ink does not remain on the top of the partition walls since the ink flows down to the sides during the process of drying ink.

The above construction solves a problem that the reflection material having stuck to the top of the partition walls becomes a hindrance in bonding the front panel and the back panel with a sealing glass.

Sample 15

PDP Samples 15 was produced based on Embodiment 13, using the Ag ink (electrode material ink) and the fluorescent substance ink of index No. 15 shown in Table 3.

The partition walls on the back panel was formed using alumina. The pitch, width, and height were respectively set to 140 μm, 30 μm, and 120 μm. A water-repellant film of polytetrafluoroethylene was formed on the top of the partition walls.

The reflection material ink contained 45% by weight of alumina ($Al_2O_3$) with grain size 0.5 μm as the reflection material, 1.0% by weight of poly(vinyl alcohol) as the binder, and 54% by weight of water as the solvent. The viscosity of the reflection material ink was set to 100 cP at 25° C.

The contact angles of the fluorescent substance ink against the side and the top water-repellant film of the partition walls were respectively about 5° and about 30°.

The aperture of nozzle was set to 100 μm.

The distance between the front-end of the nozzle and the bottom was set to 100 μm.

The reflection material ink was spouted out from the nozzles by putting pressure of 0.7 kgf/cm$^2$ and the bridge was formed. Then, the back glass substrate was moved in the direction along the partition walls at the speed of 100 mm/s while applying the reflection material ink continuously onto the surface of the channel between the partition walls so that the amount of reflection material ink applied onto the channel is about 90% of the volume of the internal space of the channel.

The reflection layer was formed after the applied reflection material ink was dried and then baked for 10 minutes at about 500° C.

Sections of the reflection layer were observed with a Scanning Electron Microscope (SEM). It was confirmed that the reflection layer had been formed evenly with about 20 μm of thickness inside the partition walls, not remaining on the top.

In general, when such a nozzle with relatively great aperture is used, the ink tends to stick to the top of the partition walls. This was not observed in the present case of Embodiment 13.

The fluorescent substance layer was then formed on the reflection layer in the same way as Embodiment 10.

Neon (Ne) gas containing 5% Xenon (Xe) gas was used as the discharge gas. The charging pressure was set to 500 Torr.

The wavelength of the ultraviolet ray was an excitation wavelength of molecular beams of Xe, mainly at 173 nm. The results of the brightness measurement are shown in Table 3.

Note that the reflection layer was also formed evenly with 20 μm of thickness on the sides of the partition walls when the reflection material ink was applied onto the channels between the partition walls by setting the surface roughness of the sides of the glass partition walls to about 5 μm and by setting the surface roughness of the top of the glass partition walls to about 0.5 μm.

Embodiment 14

The structure of PDPs of the present Embodiment is the same as Embodiment 12 in which reflection layer 130 is formed (FIG. 25).

The reflection layer 130 and fluorescent substance layer 18 are formed by applying the reflection material ink and the fluorescent substance ink using the ink applying apparatus shown in FIG. 4 for Embodiment 1.

The method of forming the fluorescent substance layer described in Embodiment 5 is applied to the formation of reflection layer 130 in the present Embodiment. That is, first, the reflection material ink is continuously applied, allowing the ink to form a bridge between the internal surfaces of the partition walls. Then, the ink is dried and baked, resulting in reflection layer 130.

To maintain the state of the reflection ink forming the bridge, it is desirable to set the distance between the front-end of the nozzles and partition walls 17 to the range of 0 μm–1 mm during operation.

As described in Embodiment 5, this method of forming the reflection layer enables the use of a low-cost ink applying apparatus for evenly applying the reflection material ink and enables the use of various materials as the reflection material ink in terms of the viscosity and the surface tension.

Fluorescent substance layer 18 is then formed on reflection layer 130 by applying fluorescent substance ink onto it, in the same way as Embodiment 5.

Note that reflection layer 130 may be formed with any of the methods described Embodiments 6, 10, and 11 by applying the above reflection material ink, generating the same effect as described above.

Sample 16

PDP Samples 16 was produced based on Embodiment 14, using the Ag ink (electrode material ink) and the fluorescent substance ink of index No. 16 shown in Table 3.

The width of the space between partition walls was set to 110 μm. The inside diameter of nozzles was set to 80 μm, the outer diameter set to 120 μm. The distance between the front-end of nozzles and the top of the partition walls was set to 20 μm.

The reflection material ink contained 30–60% by weight of titanium oxide with mean grain size 0.5–5 μm as the reflection material, 0.1–10% by weight of ethyl cellulose as the binder, and 30–60% by weight of terpineol as the solvent. The viscosity of the reflection material ink was set to 10–1000 cP at 25° C.

The reflection material ink was spouted out from the nozzles by putting a pressure of 0.5 kgf/cm$^2$ and the bridge was formed. Then, the back glass substrate was moved in the direction along the partition walls at the speed of 50 mm/s while applying the reflection material ink continuously onto the surface of the channel between the partition walls.

The reflection layer was formed after the applied reflection material ink was dried and then baked for 10 minutes at about 500° C.

The fluorescent substance layer was formed on the reflection layer with the same method as Embodiment 10.

The fluorescent substance layer was then formed on the reflection layer in the same way as Embodiment 10.

Neon (Ne) gas containing 5% Xenon (Xe) gas was used as the discharge gas. The charging pressure was set to 500 Torr.

The wavelength of the ultraviolet ray was an excitation wavelength of molecular beams of Xe, mainly at 173 nm. The results of the brightness measurement are shown in Table 3.

Sample 17

PDP Samples 17 was produced based on Embodiment 14, using the Ag ink (electrode material ink) and the fluorescent substance ink of index No. 17 shown in Table 3.

The same reflection material ink as Embodiment 16 was used. Nozzle 124 shown in FIG. 21 whose front-end edge is slant against the surface of back glass substrate 15 was used in the present Sample.

The width of the space between partition walls 17 was set to 110 μm. The inside diameter of nozzles 122 was set to 60 μm, the outer diameter set to 100 μm. The angle of inclination of the edge of nozzles 124 against the surface of back glass substrate 15 was set to 45°. The distance between the front-end of nozzles 124 and the surface of back glass substrate 15 was set to 20 μm.

Under the above condition, the fluorescent substance ink was continuously and steadily applied onto the channel between the partition walls.

The fluorescent substance layer was then formed on the reflection layer in the same way as Embodiment 10.

Neon (Ne) gas containing 5% Xenon (Xe) gas was used as the discharge gas. The charging pressure was set to 500 Torr.

The wavelength of the ultraviolet ray was an excitation wavelength of molecular beams of Xe, mainly at 173 nm. The results of the brightness measurement are shown in Table 3.

Others in the above description of Embodiments 1–14, AC-type PDPs were used. However, the present invention may be applied to other types of PDPs whose partition walls are formed in stripes.

The techniques disclosed in the above Embodiments 7, 8, 9, 12, and 13, that is, the techniques for adjusting the amount of the fluorescent substance ink or the reflection material ink sticking to the sides and the bottom of the partition walls by adjusting the adsorption of the sides and the bottom against the ink may also be applied to DC-type PDPs whose partition walls are formed in a lattice shape, generating the same effect.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

TABLE 1

| SAMPLE No. | | GRAIN SIZE AND COMPOSITIONAL RATIO | GRAIN SIZE AND COMPOSITIONAL RATIO | RESIN TYPE AND COMPOSITIONAL RATIO |
|---|---|---|---|---|
| 1 | COMPOSITION OF Ag INK | Ag 1.0 μm 50.4 wt % | GLASS 1.0 μm 5.0 wt % | ETHYL CELLULOSE 4.0 wt % |
| | COMPOSITION OF FLUORESCENT SUBSTANCE INK | FLUORESCENT SUBSTANCE 2.0 μm 30 wt % | SILICA 0.01 μm 1.0 wt % | ETHYL CELLULOSE 4.5 wt % |

TABLE 1-continued

| | | | | |
|---|---|---|---|---|
| 2 | COMPOSITION OF Ag INK | Ag 0.5 μm 40 wt % | GLASS 0.5 μm 4.4 wt % | ETHYL CELLULOSE 4.0 wt % |
| | COMPOSITION OF FLUORESCENT SUBSTANCE INK | FLUORESCENT SUBSTANCE 1.5 μm 40 wt % | SILICA 0.02 μm 4.5 wt % | ACRYLIC RESIN 20 wt % |
| 3 | COMPOSITION OF Ag INK | Ag 2.0 μm 40 wt % | GLASS 2.0 μm 3.0 wt % | ACRYLIC RESIN 20 wt % |
| | COMPOSITION OF FLUORESCENT SUBSTANCE INK | FLUORESCENT SUBSTANCE 5.0 μm 30 wt % | SILICA 0.01 μm 10 wt % | ETHYL CELLULOSE 1.0 wt % |
| 4 | COMPOSITION OF Ag INK | Ag 5.0 μm 45 wt % | GLASS 0.5 μm 5.3 wt % | ETHYL CELLULOSE 6 wt % |
| | COMPOSITION OF FLUORESCENT SUBSTANCE INK | FLUORESCENT SUBSTANCE 3.0 μm 60 wt % | SILICA 0.01 μm 10 wt % | POLY(VINYL ALCOHOL) 4.0 wt % |
| 5 | COMPOSITION OF Ag INK | Ag 1.0 μm 43.4 wt % | GLASS 1.5 μm 1.0 wt % | ETHYL CELLULOSE 5.0 wt % |
| | COMPOSITION OF FLUORESCENT SUBSTANCE INK | FLUORESCENT SUBSTANCE 0.5 μm 57.5 wt % | SILICA 0.02 μm 1.0 wt % | ETHYL CELLULOSE 5.0 wt % |

| SAMPLE No. | SOLVENT TYPE AND COMPOSITIONAL RATIO | DISPERSANT TYPE AND COMPOSITIONAL RATIO | PLASTICIZER AND COMPOSITIONAL RATIO | INK VISCOSITY | PANEL BRIGHTNESS |
|---|---|---|---|---|---|
| 1 | BUTYL CARBITOL ACETATE 40 wt % | POLYOXYETHYLENE ALKYLAMINE 0.5 wt % | BUTYL PHTHALATE 0.1 wt % | 850 (cp) | 480 (cd/cm$^2$) |
| | BUTYL CARBITOL ACETATE 62.0 wt % | POLYOXYETHYLENE ALKYLAMINE 2.0 wt % | BUTYL PHTHALATE 0.5 wt % | 10 (cp) | |
| 2 | α-TERPINEOL 50.5 wt % | GLYCERYL TRIOLEIN 1.0 wt % | BUTYL PHTHALATE 0.1 wt % | 500 (cp) | 495 (cd/cm$^2$) |
| | BUTYL CARBITOL ACETATE 33 wt % | GLYCERYL TRIOLEIN 2.0 wt % | METHYL PHTHALATE 0.5 wt % | 200 (cp) | |
| 3 | α-TERPINEOL 31 wt % | POLYOXYETHYLENE ALKYLAMINE 5 wt % | BUTYL PHTHALATE 1.0 wt % | 1000 (cp) | 480 (cd/cm$^2$) |
| | BUTYL CARBITOL ACETATE 57.5 wt % | POLYOXYETHYLENE ALKYLAMINE 1.0 wt % | ETHYL PHTHALATE 0.5 wt % | 300 (cp) | |
| 4 | α-TERPINEOL 40.5 wt % | GLYCERYL TRIOLEIN 3 wt % | BUTYL PHTHALATE 0.2 wt % | 300 (cp) | 450 (cd/cm$^2$) |
| | WATER ($H_2O$) 23 wt % | POLYOXYETHYLENE ALKYLAMINE 2 wt % | ETHYL PHTHALATE 1 wt % | 250 (cp) | |
| 5 | BUTYL CARBITOL ACETANE 50 wt % | POLYOXYETHYLENE ALKYLAMINE 0.1 wt % | ETHYL PHTHALATE 0.5 wt % | 100 (cp) | 496 (cd/cm$^2$) |
| | BUTYL CARBITOL ACETATE 35 wt % | POLYOXYETHYLENE ALKYLAMINE 1.0 wt % | ETHYL PHTHALATE 0.5 wt % | 1000 (cp) | |

TABLE 2

| SAMPLE No. | INK TYPE | INK MATERIAL AND COMPOSITION | | | | INK VISCOSITY | PANEL BRIGHT-NESS |
|---|---|---|---|---|---|---|---|
| 6 | COMPOSITION OF Ag INK | SAME AS SAMPLE 1 | | | | | 550~580 cd/m$^2$ |
| | COMPOSITION OF FLUORESCENT SUBSTANCE INK | FLUORESCENT SUBSTANCE GRAIN SIZE 0.5 μm~5 μm 20~60 wt % | ETHYL CELLULOSE (BINDER) 0.1~10 wt % | α-TERPINEOL (SOLVENT) 30~60 wt % | GLYCERYL TRIOLEIN (DISPERSANT) 0~1 wt % | 10~1000 (cp) | |
| 7 | COMPOSITION OF Ag INK | SAME AS SAMPLE 1 | | | | | 550~580 cd/m$^2$ |
| | COMPOSITION OF FLUORESCENT SUBSTANCE INK | SAME AS SAMPLE 6 | | | | | |
| 8 | COMPOSITION OF Ag INK | SAME AS SAMPLE 1 | | | | | 550~583 cd/m$^2$ |
| | COMPOSITION OF FLUORESCENT SUBSTANCE INK | SAME AS SAMPLE 6 | | | | | |
| 9 | COMPOSITION OF Ag INK | SAME AS SAMPLE 1 | | | | | 550~581 cd/m$^2$ |
| | COMPOSITION OF FLUORESCENT SUBSTANCE INK | SAME AS SAMPLE 6 | | | | | |

TABLE 2-continued

| SAMPLE No. | INK TYPE | INK MATERIAL AND COMPOSITION | | | | INK VISCOSITY | PANEL BRIGHTNESS |
|---|---|---|---|---|---|---|---|
| 10 | COMPOSITION OF Ag INK | SAME AS SAMPLE 1 | | | | | 585 cd/m$^2$ |
| | COMPOSITION OF FLUORESCENT SUBSTANCE INK | FLUORESCENT SUBSTANCE GRAIN SIZE 3 $\mu$m 45 wt % | ETHYL CELLULOSE (BINDER) 1.8 wt % | α-TERPINEOL (SOLVENT) 53.2 wt % | | 50 (cp) | |
| 11 | COMPOSITION OF Ag INK | SAME AS SAMPLE 1 | | | | | 582 cd/m$^2$ |
| | COMPOSITION OF FLUORESCENT SUBSTANCE INK | FLUORESCENT SUBSTANCE GRAIN SIZE 3 $\mu$m 45 wt % | POLY(VINYL ALCOHOL) (BINDER) 1 wt % | WATER 54 wt % | — | 100 (cp) | |
| 12 | COMPOSITION OF Ag INK | SAME AS SAMPLE 1 | | | | | 585 cd/m$^2$ |
| | COMPOSITION OF FLUORESCENT SUBSTANCE INK | SAME AS SAMPLE 10 | | | | | |
| 13 | COMPOSITION OF Ag INK | SAME AS SAMPLE 1 | | | | | 575 cd/m$^2$ |
| | COMPOSITION OF FLUORESCENT SUBSTANCE INK | SAME AS SAMPLE 10 | | | | | |

TABLE 3

| SAMPLE No. | INK TYPE | INK MATERIAL AND COMPOSITION | | | | INK VISCOSITY | PANEL BRIGHTNESS |
|---|---|---|---|---|---|---|---|
| 14 | COMPOSITION OF Ag INK | SAME AS SAMPLE 1 | | | | | 706 cd/m$^2$ |
| | COMPOSITION OF REFLECTION MATERIAL INK | TITANIUM OXIDE ($TiO_2$) GRAIN SIZE 3.0 $\mu$m 45 wt % | ETHYL CELLULOSE (BINDER) 1.8 wt % | TERPINEOL (SOLVENT) 53.2 wt % | | 50 (cp) | |
| | COMPOSITION OF FLUORESCENT SUBSTANCE INK | SAME AS SAMPLE 10 | | | | | |
| 15 | COMPOSITION OF Ag INK | SAME AS SAMPLE 1 | | | | | 696 cd/m$^2$ |
| | COMPOSITION OF REFLECTION MATERIAL INK | ALUMINA ($AL_2O_3$) GRAIN SIZE 0.5 $\mu$m 45 wt % | POLY(VINYL ALCOHOL) (BINDER) 1.0 wt % | WATER 54 wt % | | 100 (cp) | |
| | COMPOSITION OF FLUORESCENT SUBSTANCE INK | SAME AS SAMPLE 10 | | | | | |
| 16 | COMPOSITION OF Ag INK | SAME AS SAMPLE 1 | | | | | 700~703 cd/m$^2$ |
| | COMPOSITION OF REFLECTION MATERIAL INK | TITANIUM OXIDE ($TiO_2$) GRAIN SIZE 0.5~5 $\mu$m 30~60 wt % | ETHYL CELLULOSE (BINDER) 0.1~10 wt % | TERPINEOL (SOLVENT) 30~60 wt % | — | 10~1000 (cp) | |
| | COMPOSITION OF FLUORESCENT SUBSTANCE INK | SAME AS SAMPLE 10 | | | | | |
| 17 | COMPOSITION OF Ag INK | SAME AS SAMPLE 1 | | | | | 705 cd/m$^2$ |
| | COMPOSITION OF REFLECTION MATERIAL INK | SAME AS SAMPLE 16 | | | | | |
| | COMPOSITION OF FLUORESCENT SUBSTANCE INK | SAME AS SAMPLE 10 | | | | | |

What is claimed is:

1. A plasma display panel comprising:

a first plate on which there are a plurality of partition walls, formed in stripes, having a pitch between the partition walls of 0.15 mm to 0.3 mm and a fluorescent substance layer formed by applying a fluorescent substance ink continuously onto a plurality of channels between the plurality of partition walls;

a second plate being bonded with the first plate with the plurality of partition walls in between;

and a gas medium is charged into the plurality of channels sealed by the second plate, wherein adsorption of each side of each of the plurality of channels against the fluorescent substance ink is higher than adsorption of a bottom surface of each of the plurality of channels against the fluorescent substance ink.

2. A plasma display panel comprising:

a first plate on which there are a plurality of partition walls, formed in stripes, having a pitch between the partition walls of 0.15 mm to 0.3 mm and a fluorescent substance layer formed by applying a fluorescent substance ink continuously onto a plurality of channels between the plurality of partition walls, a second plate being bonded with the first plate with the plurality of partition walls in between; and a gas medium is charged into the plurality of channels sealed by the plate, wherein a contact angle of the fluorescent substance ink against each side of each of the plurality of channels is smaller than a contact angle of the fluorescent ink against a bottom surface of each of the plurality of channels.

3. A plasma display panel comprising:

a first plate on which there are a plurality of partition walls, formed in stripes, having a pitch between the partition walls of 0.15 mm to 0.3 mm and a fluorescent substance layer formed by applying a fluorescent substance ink continuously onto a plurality of channels between the plurality of partition walls, a second plate being bonded with the first plate with the plurality of partition walls in between; and a gas medium is charged into the plurality of channels sealed by the second plate, wherein a surface roughness of each side wall of each of the plurality of channels is greater than a surface roughness of a bottom surface of each of the plurality of channels.

4. The plasma display panel of claim 3 wherein the surface roughness of the side walls is approximately 5 $\mu$m.

5. The plasma display panel of claim 4 wherein the surface roughness of the channel bottom surfaces is approximately 0.5 $\mu$m.

6. A plasma display panel comprising:

a first plate on which there are a plurality of partition walls, formed in stripes, having a pitch between the partition walls of 0.15 mm to 0.3 mm and a fluorescent substance layer formed by applying a fluorescent substance ink continuously onto a plurality of channels between the plurality of partition walls, a second plate being bonded with the first plate with the plurality of partition walls in between; and a gas medium is charged into the plurality of channels sealed by the second plate, wherein an adsorption of each side wall of each of the plurality of channels against the fluorescent substance ink is higher than an adsorption of a top of each of the plurality of partition walls against the fluorescent substance ink.

7. The plasma display panel of claim 6 wherein the top of each partition wall has a lower surface roughness than the sides of the partition walls.

8. A plasma display panel comprising:

a first plate on which there are a plurality of partition walls, formed in stripes, having a pitch between the partition walls of 0.15 mm to 0.3 mm and a fluorescent substance layer formed by applying a fluorescent substance ink continuously onto a plurality of channels between the plurality of partition walls, a second plate being bonded with the first plate with the plurality of partition walls in between; and a gas medium is charged into the plurality of channels sealed by the second plate, wherein a contact angle of the fluorescent substance ink against each side wall of each of the plurality of channels is smaller than a contact angle of the fluorescent substance ink against a top of each of the plurality of partition walls.

9. A plasma display panel comprising:

a first plate on which there are a plurality of partition walls, formed in stripes, having a pitch between the partition walls of 0.15 mm to 0.3 mm and a fluorescent substance layer formed by applying a fluorescent substance ink continuously onto a plurality of channels between the plurality of partition walls, a second plate being bonded with the first plate with the plurality of partition walls in between; and a gas medium is charged into the plurality of channels sealed by the second plate, wherein surface roughness of each side wall of each of the plurality of channels is greater than surface roughness of a top of each of the plurality of partition walls.

10. The plasma display panel of claim 9 wherein the surface roughness of the side walls is approximately 5 $\mu$m and the surface roughness of the top of each partition wall is approximately 5 $\mu$m.

11. A plasma display panel comprising:

a first plate on which there are a plurality of partition walls, formed in stripes, having a pitch between the partition walls of 0.15 mm to 0.3 mm and a fluorescent substance layer formed by applying a fluorescent substance ink continuously onto a plurality of channels between the plurality of partition walls.

a second plate being bonded with the first plate with the plurality of partition walls in between, a gas medium is charged into the plurality of channels sealed by the second plate, and a reflection layer is formed by applying a reflection material ink onto the plurality of channels between the plurality of partition walls, and the fluorescent substance layer is formed on the reflection layer, wherein adsorption of each side wall of each of the plurality of channels against the fluorescent substance ink is higher than adsorption of a bottom surface of each of the plurality of channels against the fluorescent substance ink.

12. A plasma display panel comprising:

a first plate on which there are a plurality of partition walls, formed in stripes, having a pitch between the partition walls of 0.15 mm to 0.3 mm and a fluorescent substance layer formed by applying a fluorescent substance ink continuously onto a plurality of channels between the plurality of partition walls, a second plate being bonded with the first plate with the plurality of partition walls in between, a gas medium is charged into the plurality of channels sealed by the second plate, and a reflection layer is formed by applying a reflection material ink onto the plurality of channels between the plurality of partition walls, and the fluorescent substance layer is formed on the reflection layer, wherein a contact angle of the fluorescent substance ink against each side wall of each of the plurality of channels is smaller than a contact angle of the fluorescent substance ink against a bottom surface of each of the plurality of channels.

13. A plasma display panel comprising:

a first plate on which there are a plurality of partition walls, formed in stripes, having a pitch between the partition walls of 0.15 mm to 0.3 mm and a fluorescent substance layer formed by applying a fluorescent substance ink continuously onto a plurality of channels between the plurality of partition walls, a second plate being bonded with the first plate with the plurality of partition walls in between;

a gas medium is charged into the plurality of channels sealed by the second plate, and a reflection layer is formed by applying a reflection material ink onto the plurality of channels between the plurality of partition walls, and the fluorescent substance layer is formed on the reflection layer wherein a surface roughness of each side wall of each of the plurality of channels is greater than a surface roughness of a bottom surface of each of the plurality of channels.

14. The plasma display panel of claim 13 wherein the surface roughness of the side walls is approximately 5 $\mu$m.

15. The plasma display panel of claim 13 wherein the surface roughness of the side walls is approximately 5 $\mu$m.

16. A plasma display panel comprising:

a first plate on which there are a plurality of partition walls, formed in stripes, having a pitch between the partition walls of 0.15 mm to 0.3 mm and a fluorescent substance layer formed by applying a fluorescent substance ink continuously onto a plurality of channels between the plurality of partition walls, a second plate being bonded with the first plate with the plurality of partition walls in between, a gas medium is charged into the plurality of channels sealed by the second plate, and a reflection layer is formed by applying a reflection material ink onto a plurality of channels between the plurality of partition side walls, the fluorescent substance layer is formed on the reflection layer, wherein adsorption of each side wall of each of the plurality of channels against the reflection material ink is higher than adsorption of a top of each of the plurality of partition walls against the reflection material ink.

17. A plasma display panel comprising:

a first plate on which there are a plurality of partition walls, formed in stripes, having a pitch between the partition walls of 0.15 mm to 0.3 mm and a fluorescent substance layer formed by applying a fluorescent substance ink continuously onto a plurality of channels between the plurality of partition walls, a second plate being bonded with the first plate with the plurality of partition walls in between, a gas medium is charged into the plurality of channels sealed by the second plate, and a reflection layer is formed by applying a reflection material ink onto the plurality of channels between the plurality of partition walls, and the fluorescent substance layer is formed on the reflection layer, wherein a contact angle of the reflection material ink against each side wall of each of the plurality of channels is smaller than a contact angle of the reflection material ink against a top of each of the plurality of partition walls.

18. A plasma display panel comprising:

a first plate on which there are a plurality of partition walls, formed in stripes, having a pitch between the partition walls of 0.15 mm to 0.3 mm and a fluorescent substance layer formed by applying a fluorescent substance ink continuously onto a plurality of channels between the plurality of partition walls, a second plate being bonded with the first plate with the plurality of partition walls in between, a gas medium is charged into the plurality of channels sealed by the second plate, and a reflection layer is formed by applying a reflection material ink onto the plurality of channels between the plurality of partition walls, and the fluorescent substance layer is formed on the reflection layer, wherein a surface roughness of each side wall of each of the plurality of channels is greater than a surface roughness of a top of each of the plurality of partition walls.

19. A plasma display panel displaying apparatus comprising:

a plasma display panel including:

a first plate on which a plurality of partition walls having a pitch between the partition walls of 0.15 mm to 0.3 mm are formed in stripes and a fluorescent substance layer is formed by applying a fluorescent substance ink continuously onto a plurality of channels between the plurality of partition walls, a second plate being bonded with the first plate with the plurality of partition walls in between;

a gas medium is charged into the plurality of channels sealed by the second plate; and a driving circuit for driving the plasma display panel, wherein adsorption of each side wall of each of the plurality of channels against the fluorescent substance ink is higher than adsorption of a bottom surface of the plurality of channels against the fluorescent substance ink.

20. A plasma display panel displaying apparatus comprising:

a plasma display panel including:

a first plate on which a plurality of partition walls having a pitch between the partition walls of 0.15 mm to 0.3 mm are formed in stripes and a fluorescent substance layer is formed by applying a fluorescent substance ink continuously onto a plurality of channels between the plurality of partition walls, a second plate being bonded with the first plate with the plurality of partition walls in between;

a gas medium is charged into the plurality of channels sealed by the second plate; and a driving circuit for driving the plasma display panel, wherein a contact angle of the fluorescent substance ink against each side wall of each of the plurality of channels is smaller than a contact angle of the fluorescent substance ink against a bottom surface of each of the plurality of channels.

21. A plasma display panel displaying apparatus comprising:

a plasma display panel including:

a first plate on which a plurality of partition walls having a pitch between the partition walls of 0.15 mm to 0.3 mm are formed in stripes and a fluorescent substance layer is formed by applying a fluorescent substance ink continuously onto a plurality of channels between the plurality of partition walls, a second plate being bonded with the first plate with the plurality of partition walls in between;

a gas medium is charged into the plurality of channels sealed by the second plate; and a driving circuit for driving the plasma display panel, wherein a surface roughness of each side wall of each of the plurality of channels is greater than surface roughness of a bottom surface of each of the plurality of channels.

22. A plasma display panel displaying apparatus comprising:

a plasma display panel including:

a first plate on which a plurality of partition walls having a pitch between the partition walls of 0.15 mm to 0.3 mm are formed in stripes and a fluorescent substance layer is formed by applying a fluorescent substance ink continuously onto a plurality of channels between the plurality of partition walls, a second plate being bonded with the first plate with the plurality of partition walls in between;

a gas medium is charged into the plurality of channels sealed by the second plate; and a driving circuit for driving the plasma display panel, wherein adsorption of each side wall of each of the plurality of channels against the fluorescent substance ink is higher than adsorption of a top of each of the plurality of partition walls against the fluorescent substance ink.

23. A plasma display panel displaying apparatus comprising:

a plasma display panel including:

a first plate on which a plurality of partition walls having a pitch between the partition walls of 0.15 mm to 0.3 mm are formed in stripes and a fluorescent substance layer is formed by applying a fluorescent substance ink continuously onto a plurality of channels between the plurality of partition walls, a second plate being bonded with the first plate with the plurality of partition walls in between;

a gas medium is charged into the plurality of channels sealed by the second plate; and a driving circuit for driving the plasma display panel, wherein a contact angle of the fluorescent substance ink against each side wall of each of the plurality of channels is smaller than a contact angle of the fluorescent substance ink against a top of each of the plurality of partition walls.

24. A plasma display panel displaying apparatus comprising:

a plasma display panel including:

a first plate on which a plurality of partition walls having a pitch between the partition walls of 0.15 mm to 0.3 mm are formed in stripes and a fluorescent substance layer is formed by applying a fluorescent substance ink continuously onto a plurality of channels between the plurality of partition walls, a second plate being bonded with the first plate with the plurality of partition walls in between;

a gas medium is charged into the plurality of channels sealed by the second plate; and a driving circuit for driving the plasma display panel, wherein a surface roughness of each side wall of each of the plurality of channels is greater than a surface roughness of a top of each of the plurality of partition walls.

25. A plasma display panel displaying apparatus comprising:

a plasma display panel including:

a first plate on which there are a plurality of partition walls, formed in stripes, having a pitch between the partition walls of 0.15 mm to 0.3 mm and a reflection layer formed by applying a reflection material ink onto a plurality of channels between the plurality of partition walls, and there is a fluorescent substance layer formed on the reflection layer by applying a fluorescent substance ink onto the plurality of channels;

a second plate being bonded with the first plate with the plurality of partition walls in between;

a gas medium is charged into the plurality of channels sealed by the second plate; and a driving circuit for driving the plasma display panel, wherein adsorption of each side wall of each of the plurality of channels against the fluorescent substance ink is higher than adsorption of a bottom surface of each of the plurality of channels against the fluorescent substance ink.

26. A plasma display panel displaying apparatus comprising:

a plasma display panel including:

a first plate on which there are a plurality of partition walls, formed in stripes, having a pitch between the partition walls of 0.15 mm to 0.3 mm and a reflection layer formed by applying a reflection material ink onto a plurality of channels between the plurality of partition walls, and there is a fluorescent substance layer formed on the reflection layer by applying a fluorescent substance ink onto the plurality of channels;

a second plate being bonded with the first plate with the plurality of partition walls in between;

a gas medium is charged into the plurality of channels sealed by the second plate; and a driving circuit for driving the plasma display panel, wherein a contact angle of the fluorescent substance ink against each side wall of each of the plurality of channels is smaller than a contact angle of the fluorescent substance ink against a bottom surface of each of the plurality of channels.

27. A plasma display panel displaying apparatus comprising:

a plasma display panel including:

a first plate on which there are a plurality of partition walls, formed in stripes, having a pitch between the partition walls of 0.15 mm to 0.3 mm and a reflection layer formed by applying a reflection material ink onto a plurality of channels between the plurality of partition walls, and there is a fluorescent substance layer formed on the reflection layer by applying a fluorescent substance ink onto the plurality of channels;

a second plate being bonded with the first plate with the plurality of partition walls in between;

a gas medium is charged into the plurality of channels sealed by the second plate; and a driving circuit for driving the plasma display panel, wherein a surface roughness of each side wall of each of the plurality of channels is greater than a surface roughness of a bottom surface of each of the plurality of channels.

28. The plasma display panel of claim 27 wherein the surface roughness of the side walls is approximately 0.51 $\mu$m.

29. The plasma display panel of claim 28 wherein the surface roughness of the channel bottom surface is approximately 0.5 $\mu$m.

30. A plasma display panel displaying apparatus comprising:

a plasma display panel including:

a first plate on which there are a plurality of partition walls, formed in stripes, having a pitch between the partition walls of 0.15 mm to 0.3 mm and a reflection layer formed by applying a reflection material ink onto a plurality of channels between the plurality of partition walls, and there is a fluorescent substance layer formed on the reflection layer by applying a fluorescent substance ink onto the plurality of channels;

a second plate being bonded with the first plate with the plurality of partition walls in between;

a gas medium is charged into the plurality of channels sealed by the second plate; and a driving circuit for driving the plasma display panel, wherein adsorption of each side wall of each of the plurality of channels against the reflection material ink is higher than adsorption of a top of each of the plurality of partition walls against the reflection material ink.

31. A plasma display panel displaying apparatus comprising:

a plasma display panel including:

a first plate on which there are a plurality of partition walls, formed in stripes, having a pitch between the partition walls of 0.15 mm to 0.3 mm and a reflection layer formed by applying a reflection material ink onto a plurality of channels between the plurality of partition walls, and there is a fluorescent substance layer formed on the reflection layer by applying a fluorescent substance ink onto the plurality of channels;

a second plate being bonded with the first plate with the plurality of partition walls in between;

a gas medium is charged into the plurality of channels sealed by the second plate; and a driving circuit for driving the plasma display panel, wherein a contact angle of the reflection material ink against each side wall of each of the plurality of channels is smaller than a contact angle of the reflection material ink against a top of each of the plurality of partition walls.

32. A plasma display panel displaying apparatus comprising:

a plasma display panel including:

a first plate on which there are a plurality of partition walls, formed in stripes, having a pitch between the partition walls of 0.15 mm to 0.3 mm and a reflection layer formed by applying a reflection material ink continuously onto a plurality of channels between the plurality of partition walls, and there is a fluorescent substance layer formed on the reflection layer by applying a fluorescent substance ink onto the plurality of channels;

a second plate being bonded with the first plate with the plurality of partition walls in between;

a gas medium is charged into the plurality of channels sealed by the second plate; and a driving circuit for driving the plasma display panel, wherein a surface roughness of each side wall of each of the plurality of channels is greater than surface roughness of a top of each of the plurality of partition walls.

33. The plasma display panel of claim 32 wherein the surface roughness of the side walls is approximately 5 $\mu$m and the surface roughness of the top of each partition wall is approximately 0.5 $\mu$m.

* * * * *

UNITED STATES PATENT AND TRADEMARK OFFICE

CERTIFICATE OF CORRECTION

PATENT NO. : 6,369,501 B1 
DATED : April 9, 2002
INVENTOR(S) : Masaki Aoki, Shigeo Suzuki, Mitsuhiro Ohtani, Hiroyuki Kawamura and Hiroyuki Kado It is certified that error appears in the above-identified patent and that said Letters Patent is hereby corrected as shown below:

Column 36,
Line 61, delete "0.51" and insert -- 0.5 --.

Signed and Sealed this

Fifth Day of November, 2002

*Attest:*

*Attesting Officer*

JAMES E. ROGAN
*Director of the United States Patent and Trademark Office*